US011015622B2

(12) United States Patent
Socolovsky

(10) Patent No.: US 11,015,622 B2
(45) Date of Patent: May 25, 2021

(54) HYDRAULIC INTENSIFIERS, BOOSTERS AND/OR CONTROLLERS

(71) Applicant: Eviatar Socolovsky, Shavei Tzion (IL)

(72) Inventor: Eviatar Socolovsky, Shavei Tzion (IL)

( * ) Notice: Subject to any disclaimer, the term of this patent is extended or adjusted under 35 U.S.C. 154(b) by 0 days.

(21) Appl. No.: 17/067,697

(22) Filed: Oct. 11, 2020

(65) Prior Publication Data

US 2021/0033117 A1 Feb. 4, 2021

Related U.S. Application Data

(63) Continuation-in-part of application No. PCT/IB2019/053063, filed on Apr. 15, 2019.

(60) Provisional application No. 62/658,606, filed on Apr. 17, 2018, provisional application No. 62/915,279, filed on Oct. 15, 2019.

(51) Int. Cl.

| | |
|---|---|
| ***F15B 15/18*** | (2006.01) |
| ***F15B 3/00*** | (2006.01) |
| ***F15B 11/032*** | (2006.01) |
| ***F15B 11/02*** | (2006.01) |
| ***F15B 1/02*** | (2006.01) |

(52) U.S. Cl.

CPC ..... *F15B 15/18* (2013.01); *F15B 1/024* (2013.01); *F15B 3/00* (2013.01); *F15B 11/022* (2013.01); *F15B 11/032* (2013.01); *F15B 11/0325* (2013.01); *F15B 2211/20576* (2013.01); *F15B 2211/20592* (2013.01); *F15B 2211/214* (2013.01)

(58) Field of Classification Search

CPC ..... F15B 1/024; F15B 3/00; F15B 11/022; F15B 11/032; F15B 11/0325; F15B 15/18; F15B 2211/20576; F15B 2211/20592; F15B 2211/214

See application file for complete search history.

(56) References Cited

U.S. PATENT DOCUMENTS

| | | | | |
|---|---|---|---|---|
| 3,188,963 A * | 6/1965 | Tyler | F15B 3/00 | 417/225 |
| 3,385,217 A * | 5/1968 | Bles | F15B 3/00 | 417/287 |
| 3,760,689 A * | 9/1973 | Johnston | E02F 9/2239 | 91/519 |
| 3,952,516 A | 4/1976 | Lapp | | |
| 4,366,673 A * | 1/1983 | Lapp | F15B 3/00 | 60/477 |

(Continued)

FOREIGN PATENT DOCUMENTS

FR 2977512 A1 * 1/2013 ..... B23K 11/36

*Primary Examiner* — Abiy Teka
*Assistant Examiner* — Matthew Wiblin
(74) *Attorney, Agent, or Firm* — The Law Office of Joseph L. Felber

(57) ABSTRACT

A hydraulic intensifier and/or booster (HIB) for transforming an incoming hydraulic pressure at a relative low-pressure to an amplified outgoing hydraulic pressure at a relative high-pressure. The HIB comprising a hydraulic motor and an intensifying mechanism, possibly a hydraulic screw pump mechanism, wherein the hydraulic motor being arranged from the incoming hydraulic pressure to output power. The intensifying mechanism being arranged to receive the outputted power from the hydraulic motor and transform it to linear power of a piston and via the piston being arranged to build the amplified outgoing hydraulic pressure.

33 Claims, 18 Drawing Sheets

(56) References Cited

U.S. PATENT DOCUMENTS

| | | | | |
|---|---|---|---|---|
| 4,671,063 | A * | 6/1987 | Anaker | F04B 23/106 60/458 |
| 5,117,633 | A * | 6/1992 | Bayer | F15B 11/0725 251/59 |
| 7,374,146 | B2 * | 5/2008 | Whitby | E21B 33/062 251/1.3 |
| 2011/0176940 | A1 | 7/2011 | Ellis et al. | |
| 2015/0052888 | A1 | 2/2015 | Clausen et al. | |
| 2016/0010418 | A1 * | 1/2016 | Van Wijk | E21B 33/0355 166/363 |
| 2016/0053749 | A1 | 2/2016 | Hunter | |
| 2017/0130743 | A1 | 5/2017 | Anderson | |
| 2017/0241446 | A1 * | 8/2017 | Luepke | F15B 21/005 |

* cited by examiner

HYDRAULIC INTENSIFIERS, BOOSTERS AND/OR CONTROLLERS

CROSS-REFERENCE TO RELATED APPLICATIONS

The present application is a continuation-in-part of International Application No. PCT/IB2019/053063, filed Apr. 15, 2019, which claims benefit of U.S. Provisional Application No. 62/658,606, filed Apr. 17, 2018. The present application also claims benefit of U.S. Provisional Application No. 62/915,279, filed Oct. 15, 2019. All of the preceding applications are hereby incorporated by reference in their entireties.

TECHNICAL FIELD

Embodiments of the invention relate to hydraulic intensifiers and/or boosters, in particular for boosting pressures in a hydraulic circuit to which hydraulic components are connected.

BACKGROUND

Hydraulic intensifiers are arranged to receive incoming hydraulic fluid from a low-pressure source and transform this pressure to an outgoing high-pressure that may be fed to a high-pressure line that may activate hydraulic actuators and/or devices. Such hydraulic intensifier devices may employ one or more actuators and/or devices.

Hydraulic intensifiers may be used in a variety of applications such as for propelling hydraulic jacks, activating work holding devices and hydraulic presses or e.g. for providing lifting forces that are otherwise not possible with the existing systems' tubing and its low-pressure source.

U.S. Pat. No. 3,952,516 provides one example of a hydraulic intensifier where a low pressure driven hydraulic motor actuates a high-pressure pump that increases the pressure of the oil and communicates onwards for further use by utilities. The low-pressure oil from the utilities later returns to the supply source.

SUMMARY

The following embodiments and aspects thereof are described and illustrated in conjunction with systems, tools and methods which are meant to be exemplary and illustrative, not limiting in scope.

In an embodiment of the invention provided there is a hydraulic intensifier and/or booster (HIB) for transforming an incoming hydraulic pressure at a relative low-pressure up to about 100 Bar or possibly up to about 70 Bar to an amplified outgoing hydraulic pressure at a relative high-pressure, the HIB comprising a hydraulic motor and an intensifying mechanism, possibly a hydraulic screw pump mechanism, wherein the hydraulic motor being arranged to output power, and the intensifying mechanism being arranged to receive the outputted power from the hydraulic motor and transform it to linear power of a piston, wherein the intensifying mechanism via the piston being arranged to build the amplified outgoing hydraulic pressure at the high-pressure line.

In certain embodiments there is also provided a hydraulic controller for hydraulically controlling the logic of the operation of the work holding devices on a hydraulic work holding fixture by transforming incoming hydraulic pressure at a relative low-pressure to a plurality of outgoing hydraulic pressure routes at relatively higher pressures, the controller comprising a plurality of sequence valves each being configured to permit fluid to pass onwards downstream only after pressure upstream exceeds certain pre-defined, possibly adjustable, thresholds, wherein each sequence valve has a different threshold.

Possibly such controllers may be stand-alone devices arranged to be releasably coupled to external tools and/or devices that can be activated by hydraulic power, such as those of a work holding fixtures (HWF) or the like.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1:
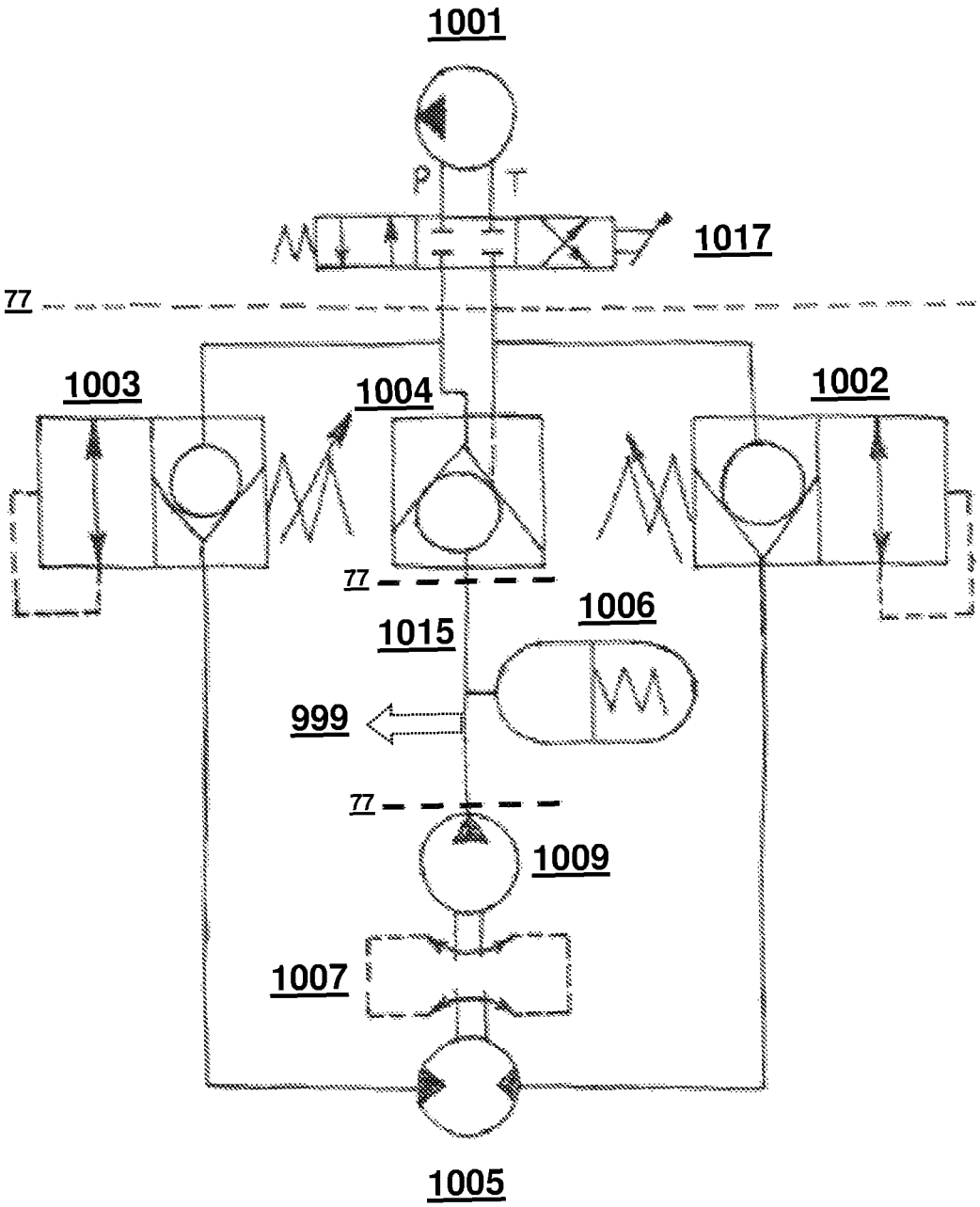
FIG. 1 schematically shows a hydraulic diagram illustrating an embodiment of a hydraulic intensifier and/or booster (HIB) of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Attention is first drawn to FIG. 1 illustrating in part an embodiment of a hydraulic intensifier and/or booster (HIB)

of the invention, which may be arranged to receive incoming low pressure, here from a low-pressure pump 1001 providing up to about 100 Bar or possibly up to about 70 Bar—and transform this pressure to an outgoing high pressure that may be fed to a high-pressure line 1015.

The 'dash-dotted' lines 77 marked in FIG. 1 bounding/delimiting "components" of 'low-pressure pump' and 'high-pressure line'—indicate the option of these "components" not necessarily being part of the HIB embodiments described herein but rather external "components" with which at least certain HIB embodiments may be fitted to be in fluid communication. Nevertheless, certain HIB embodiments may on the other hand be arranged to include these "components" integrally therein.

A principle possibly applicable to most HIB embodiments may be use of hydraulic power for control/activating of transitions within the HIB resulting in outgoing changes in pressure which are configured to urge changes in externally coupled components/appliances (such as Work Supports, Hydraulic jack and the like). Such hydraulic control/activation instead of e.g. electrically activated or controlled mechanisms—may be more suitable for certain environments such as environments where fluids such as oil or water may be present and/or environments where moving parts may render use of electrical wiring (or the like) less suitable. In at least certain embodiments, such transitions within the HIB may be due to changes in incoming low pressures into the HIB from a low-pressure pump resulting in provision of outgoing higher pressures for the activation of externally coupled components/appliances.

Pump 1001 may be arranged to supply power by urging hydraulic fluid to flow downstream. Pump 1001 has a 'P' (pressure) side/port indicating a direction towards which fluid is urged to move into a hydraulic circuit and a 'T' (tank) side/port indicating a side receiving fluid back from the circuit. Fluid power provided downstream may be defined, inter alia, by fluid pressure [N\m^2] and flow rate [m^3\sec].

It is noted that reference(s) to low pressure pump(s) when used in various embodiments herein—may possibly refer to a pump arranged to generally provide the above cited pressure ranges. In addition, it is noted that reference to hydraulic fluid when used herein may in a typical example refer to oil, such as ISO 32 oil possibly suitable for use in common power supplies and work-holding components (and the like);

The fluid power provided by pump 1001, when being directed to flow according to the left stage of directional valve 1017, may be arranged to arrive substantially simultaneously at a sequence valve 1003 and a pilot-operated check valve 1004 of the HIB. Sequence valve 1003 of the HIB can be configured to permit fluid to pass onwards downstream only after pressure upstream of the valve 1003 exceeds a pre-defined, possibly adjustable, threshold. Sequence valve 1003 in one example may include an adjustable spring-loaded mechanism for resisting opening of the valve until pressure upstream (here provided by pump 1001) builds-up and overcomes the spring and consequently opens the valve for downstream flow. This description may possibly be suitable for substantially all sequence valves described herein.

Still before sequence valve 1003 opens, fluid power exiting port 'P' of the pump may flow downstream via the pilot-operated check valve 1004 of the HIB to fill the high-pressure line 1015 in fluid communication with the HIB. Pressure line 1015 may be arranged to feed and provide fluid pressure to hydraulic components/appliances 999, which are in fluid communication with line 1015.

Appliances/components 999 powered by various HIB embodiments may be: Hydraulic Work Supports, Hydraulic jack, Hydraulic power pack, Torque wrenches, Nut splitters (etc.). Such appliances/components 999 may be for use in any one of the following applications: work holding, oil/gas drilling (drill rig), oil/gas pipe handling, railroad welding, railroad tools, railroad maintenance work, hydraulic rescue/breaching tools, submarine/under water wire cutting, submarine/under water-seal testing, submarine/under water-linear valve override tool, demolition, crusher bucket, hook lift trailer, excavators & mini-excavators, hydraulic jack, hydraulic power pack, bolt tensioners, nut splitters, torque wrenches, test stands (and the like).

Thus, such appliances/components 999 may be exposed in many cases to external loads and providing incoming high pressures to such elements 999 may urge such elements 999 to withstand the external loads they are subjected to, and by that perform their intended purpose. For example, an appliance/component 999 in the form of a hydraulic work support may typically be exposed to external load of an object it is designed to support without substantially retreating—and providing the hydraulic work support with incoming high pressure from upstream, may enable the work support to withstand the external load e.g. without a possible plunger included therein substantially retreating.

In at least most HIB embodiments, fluid entering pressure line 1015 through check valve 1004 encounters a downstream side of an intensifier piston 1009 of the HIB and then fills the hydraulic circuit line, including all hydraulic components 999 connected to it, with hydraulic fluid. In addition, fluid filling pressure line 1015 may be urged to fill an accumulator 1006 in fluid communication with line 1015. Accumulator (such as 1006) as referred to herein in the various embodiments may also be a single acting, spring return cylinder (see, e.g., spring return 16 in embodiment of FIG. 3B).

An aspect applicable to at least most embodiments, relates to mechanisms utilized in various embodiments described herein (of either HIB or HC utilities)—being arranged to include so-called 'zero leak mechanisms', possibly relying on dynamic seals (such as seal 99 marked in FIG. 2) for sealing between moving parts during the intensification process and on check valves\pilot operated check valves for sealing between two sections of a hydraulic line. After high pressure has been achieved geometry of possible lead screw threads of intensifying mechanism may prevent the release of the intensifying piston (self-locking) and thus the dynamic seal, now in static position, maintains the high-pressure achieved in high-pressure line. Such reliance on a so-called 'zero leak mechanisms', permits use of substantially un-filtered hydraulic fluid that does not undergo substantial filtering prior to being communicated to the utilities. This may be in contrast to utilities relaying on other types of sealing mechanisms, such as Spool Valves that rely on tight tolerance between moving parts for sealing—which may typically require prior filtering of hydraulic fluids used in such utilities.

In the illustrated example, hydraulic pressure may build up substantially simultaneously and uniformly in the hydraulic circuit line between port "P" and adjustable sequence valve 1003 and in the hydraulic circuit line between port "P" and leading up to a downstream side of intensifier piston 1009, including high-pressure line 1015 and elements 999 in communication therewith.

In some examples, applicable to the present invention, pressurized hydraulic fluid in high-pressure line 1015 may meet a downstream face of the intensifier piston and consequently load it. Such loaded piston in at least certain embodiments may exert an axial force on possible threads of a lead screw (such as those of the lead screw connecting spline shaft 12 and piston 14 in FIG. 2) creating a force of friction between these threads and corresponding internal threads of a lead nut. As line pressure on intensifier piston face increases, the aforementioned frictional force may increase possibly proportionally to the line pressure. The frictional force may subsequently load the hydraulic motor output shaft.

Since all hydraulic components connected to high pressure line 1015 are already substantially filled with hydraulic fluid and "trapped" between the pilot-operated check valve 1004 and intensifier piston 1009, as described above, any increase in pressure made by intensifier piston 1009, derived in this example from the rotation of the spline shaft/lead screw may be arranged to directly affect the hydraulic components 999 in fluid communication with pressure line 1015.

Once upstream line pressure exceeds the threshold set in sequence valve 1003, the sequence valve 1003 may open and the hydraulic fluid may flow downstream towards the hydraulic motor. Since the output shaft of the hydraulic motor is already loaded as described above, the pressure of the hydraulic fluid in line between port "P" and hydraulic motor 1005 builds up.

Once upstream line pressure formed by pump 1001 and communicated downstream via port "P" exceeds the pressure set in sequence valve 1003, hydraulic fluid passes valve 1003 and reaches hydraulic motor 1005 to begin its operation. The hydraulic motor receives power from the hydraulic fluid in the form of pressure [N\m^2] and flow rate [m^3\sec] and may supply power in the form of torque [Nm] and angular speed [rad\sec]. This power may be communicated downstream via a gear 1007 of the HIB to intensifier piston 1009.

The output shaft of the hydraulic motor may now rotate. A mechanism may be arranged to convert this rotational power in the form of torque [Nm] and angular speed [rad\sec] into linear power at intensifier piston, in the form of force [N] and stroke speed [m\sec]. This movement of intensifier piston 1009 may bear against the external loads applied upon appliances/components 999 and rise of pressure in line 1015 may urge the appliances/components 999 to overcome the external loads applied on them to perform their intended use/purpose.

Pump 1001 in at least certain embodiments may be set in advance to stop supplying hydraulic fluid when pressure exposed on its port "P" from downstream reaches a given 'pump pressure limit' (e.g. between about 40 and 70 Bar). Such setting of the 'pump pressure limit' may be via a toggle or the like possibly available on the pump and/or via response to a pressure gauge monitoring pressure of the pump. In certain embodiments, pressure rising in line 1015 against the external loads applied on components 999, at a certain level may reach a 'motor pressure limit' where hydraulic motor 1005 stops to rotate and advance its piston to build further pressure in line 1015. In embodiments where the 'pump pressure limit' is set to be a higher than 'motor pressure limit'—the pump may continue to build pressure until pressure at its port "P" will reach the 'pump pressure limit' resulting in pump 1001 substantially stopping its operation. If pressure on pump 1001 drops for some reason, the pump may resume operation automatically and build up pressure again.

In certain embodiments, geometry of possible lead screw threads of mechanism 1009 may prevent the release of the intensifying piston (self-locking) and thus maintains the high-pressure achieved in high-pressure line 1015.

Reversing the action of the hydraulic circuit, by changing the circuit flow direction, for example by a possible directional control valve 1017, operated manually (as also shown in FIG. 1) or by solenoid, may permit unloading of the pressure within pressure line 1015. The fluid power provided by pump 1001 may now be arranged, when being directed to flow according to the right stage of directional valve 1017, to arrive substantially simultaneously at a sequence valve 1002 and a pilot-operated check valve 1004 of the HIB.

In at least certain embodiments, still before sequence valve 1002 opens, fluid power exiting port 'P' of the pump may flow downstream towards the HIB's pilot-operated check valve 1004 and urge it to open and release pressure at a downstream side of pressure line 1015. Thrust on hydraulic motor 1005, gear 1007 and mechanism 1009 may be released substantially simultaneously together with the pressure release. In certain embodiments, the above may be the case by appropriately defining a reduction ratio of pilot to check pressure for release (5:1 in one example) of pilot operated check valve 1004. In certain embodiments, it may be set in advance that an opening pressure of the check valve may be less than an opening pressure set for sequence valve 1002—so that the release of pilot-operated check valve 1004 may occur before sequence valve 1002 opens.

Once upstream line pressure exceeds the threshold set in sequence valve 1002, the sequence valve 1002 may open and the hydraulic fluid may flow downstream towards the hydraulic motor 1005. Since the output shaft of the hydraulic motor may substantially not be loaded, as possibly described above, the hydraulic fluid may flow via a sequence valve 1002 of the HIB towards hydraulic motor 1005 to urge it to rotate in a reverse direction, retracting the piston, while at least one of accumulator, single acting spring return cylinder 1006—may replenish the volume of hydraulic fluid utilized in the intensification stroke, possibly preparing it for the next intensification cycle. This may ensure that the intensification stroke will start and end at approximately the same points in the intensification cylinder from cycle to cycle. By this reverse action, the hydraulic components/appliances 999 in communication with pressure line 1015 may be de-activated.

The description above substantially relates to a first operation cycle of the HIB. From the second cycle onwards, all hydraulic circuit lines and components may be substantially filled with hydraulic fluid at about atmospheric pressure. Such a condition of the circuit lines being substantially full upon commencement of a subsequent second (or following) cycle may decrease the response time of pressure rise in high-pressure line 1015 and of the HIB as a whole. Thus, typically a faster action may be envisioned since the lines start the operation cycle full of hydraulic fluid and pressure buildup starts substantially immediately. The role of the accumulator\single acting, spring return cylinder 1006 may be to replenish the volume of hydraulic fluid utilized in the intensification stroke, preparing it for the next intensification cycle. This may ensure that the intensification stroke will start and end at approximately the same points in the intensification cylinder from cycle to cycle. The aforementioned principle of faster response times for pressure build ups at the high-pressure line, from a second cycle of operation and onwards, and the principle of power transfer from the beginning at the pump, to its end at the high-pressure activated components which under external load, throughout all mechanisms and components in between them, may be applicable to at least most embodiments described herein and therefore will not be repeated.

Figure 2:
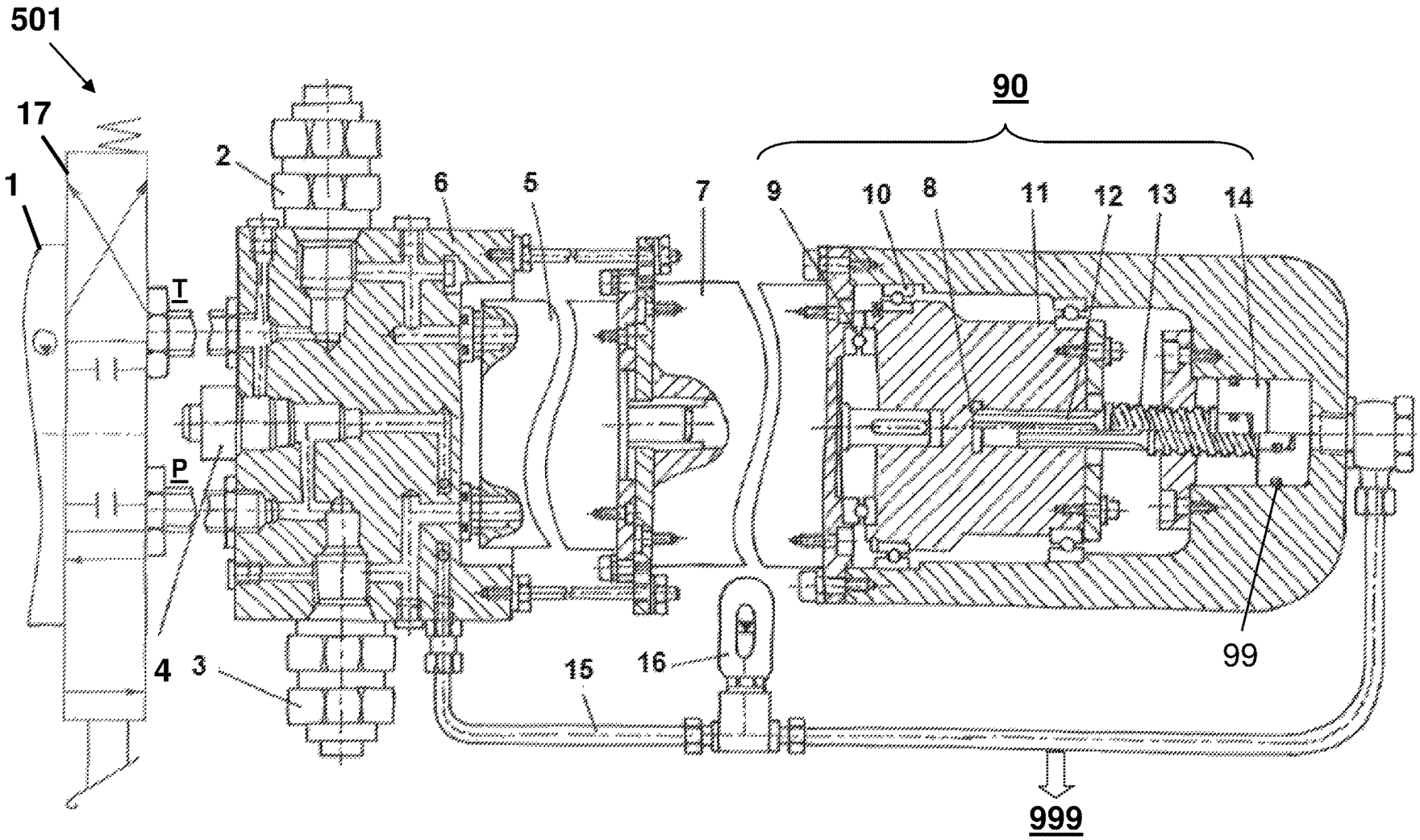
FIG. 2 schematically shows an embodiment of a hydraulic intensifier and/or booster (HIB) of the invention.

Attention is drawn to FIG. 2 illustrating an embodiment of a hydraulic intensifier and/or booster (HIB) 501 of the invention. A low-pressure pump 1 has a 'P' (pressure) side/port indicating a direction towards which fluid may be urged to move into a hydraulic circuit and a 'T' (tank) side/port indicating a side receiving fluid back from the circuit. Fluid power provided downstream may be defined, inter alia, by fluid pressure [N\m^2] and flow rate [m^3\sec].

The fluid power provided by pump 1, when being directed to flow according to the left stage of directional valve 17, may be arranged to arrive substantially simultaneously at a sequence valve 3 and a pilot-operated check valve 4 of HIB 501. Sequence valve 3 of HIB 501 may be configured to permit fluid to pass onwards downstream only after pressure upstream of the valve 3 exceeds a pre-defined, possibly adjustable, threshold. Sequence valve 3 in one example may include an adjustable spring-loaded mechanism that resists opening the valve until the pressure upstream (here provided by pump 1) manages to overcome the spring and consequently open the valve for downstream flow.

Still before sequence valve 3 opens, fluid power exiting port 'P' of the pump may also flow downstream via the pilot-operated check valve 4 of HIB 501 to fill a high-pressure line 15 in communication with the HIB. Pressure line 15 may be arranged to feed and provide fluid pressure to hydraulic components/appliances 999, which are in fluid communication with line 15. The fluid entering pressure line 15 through the pilot-operated check valve 4 may encounter a downstream side of an intensifier piston of the HIB. The fluid entering pressure line 15 may then fills the hydraulic circuit line 15, including substantially all hydraulic components 999 connected to it, with hydraulic fluid. In addition, fluid filling pressure line 15 may be urged to fill an accumulator\single acting, spring return cylinder 16.

Once upstream line pressure exceeds the threshold set in sequence valve 3, the sequence valve opens and the hydraulic fluid flows downstream to operate a hydraulic motor 5 of the HIB. The hydraulic motor may supply power in the form of torque [Nm] and angular speed [rad\sec]. This power may be communicated downstream here via a planetary gearbox 7 of the HIB to mechanism 90, which increases pressure of the hydraulic fluid in pressure line 15.

Mechanism 90 in this example is seen including thrust 9 and radial 10 bearings, a stopper 8, a spline bushing 11, a spline shaft 12 which may be connected to a lead screw with piston 14 connected to it as shown. Piston 14 is embodied in this figure in a split view in order to illustrate the full stroke that the piston may traverse during a pressure intensification process. The upper half of piston 14 is seen at a relative rear state and the lower half of piston 14 at a relative forward state after completion of a stroke activated by the mechanism.

Since substantially all hydraulic components connected to high pressure line 15 may already be substantially filled with hydraulic fluid and "trapped" between the pilot-operated check valve 4 and intensifier piston 14, as described above, any increase in pressure made by mechanism 90 may be arranged to directly affect the hydraulic components 999 in communication with pressure line 15.

Pump 1 in at least certain embodiments may be set in advance to stop supplying hydraulic fluid when the pressure built on port "P" reaches a given 'pump pressure limit' (e.g. between about 40 and 70 Bar). Such setting of the 'pump pressure limit' may be via a toggle or the like possibly available on the pump and/or via response to a pressure gauge monitoring pressure of the pump. In certain embodiments, pressure rising in line 15 against the external loads applied on components 999 at a certain level may reach a 'motor pressure limit' where hydraulic motor 5 stops to rotate and advance its piston to build further pressure in line 15. In embodiments where the 'pump pressure limit' is set to be a higher than 'motor pressure limit'—the pump may continue to build pressure until pressure at its port "P" will reach the 'pump pressure limit' resulting in pump 1 substantially stopping its operation. If pressure on pump 1 drops for some reason, the pump may resume operation automatically and build up pressure again.

In certain embodiments, geometry of possible lead screw threads of mechanism 90 may prevent the release of the intensifying piston (self-locking) and thus maintain the high-pressure achieved in high-pressure line 15.

Reversing the action of the hydraulic circuit, by changing the circuit flow direction, for example by a directional control valve 17, operated manually (as also shown in FIG. 2) or by a solenoid, may permit unloading pressure within pressure line 15. The fluid power provided by pump 1, when being directed to flow according to the right stage of directional valve 17, may now be arranged to arrive substantially simultaneously at a sequence valve 2 and a pilot-operated check valve 4 of the HIB.

Still before sequence valve 2 opens, fluid power exiting port 'P' of the pump may flow downstream towards the pilot-operated check valve 4 of the HIB and urge it to open and release pressure at a downstream side of pressure line 15. Thrust on hydraulic motor 5, gear 7 and mechanism 90 may be released substantially simultaneously together with the pressure release. In certain embodiments, the above may be the case by appropriately defining a reduction ratio of pilot to check pressure for release (5:1 in one example) of pilot operated check valve 4. In certain embodiments, it may be set in advance that an opening pressure of the check valve may be lesser than the opening pressure set for sequence valve 2—so that the release of pilot-operated check valve 4 may occur before sequence valve 2 opens.

Once upstream line pressure exceeds the threshold set in sequence valve 2, the sequence valve 2 may open and the hydraulic fluid may flow downstream towards the hydraulic motor 5. Since the output shaft of the hydraulic motor may substantially not be loaded, as possibly described above, the hydraulic fluid may flow via a sequence valve 2 of the HIB towards hydraulic motor 5 to urge it to rotate in a reverse direction, retracting the piston, while at least one of accumulator, single acting spring return cylinder 16—may replenish the volume of hydraulic fluid utilized in the intensification stroke, possibly preparing it for the next intensification cycle. This may ensure that the intensification stroke will start and end at approximately the same points in the intensification cylinder from cycle to cycle. By this reverse action, the hydraulic components/appliances 999 in communication with pressure line 15 may be de-activated.

Figure 3A:
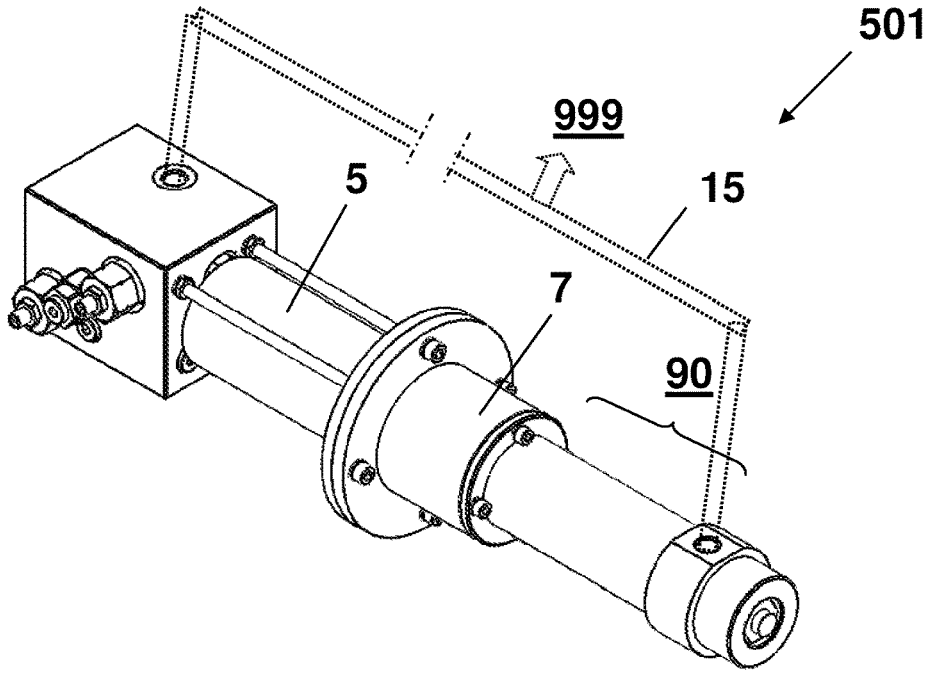
FIGS. 3A and 3B schematically show perspective views of an embodiment of a hydraulic intensifier and/or booster (HIB) of the invention generally similar to that in FIG. 2.
Figure 3B:
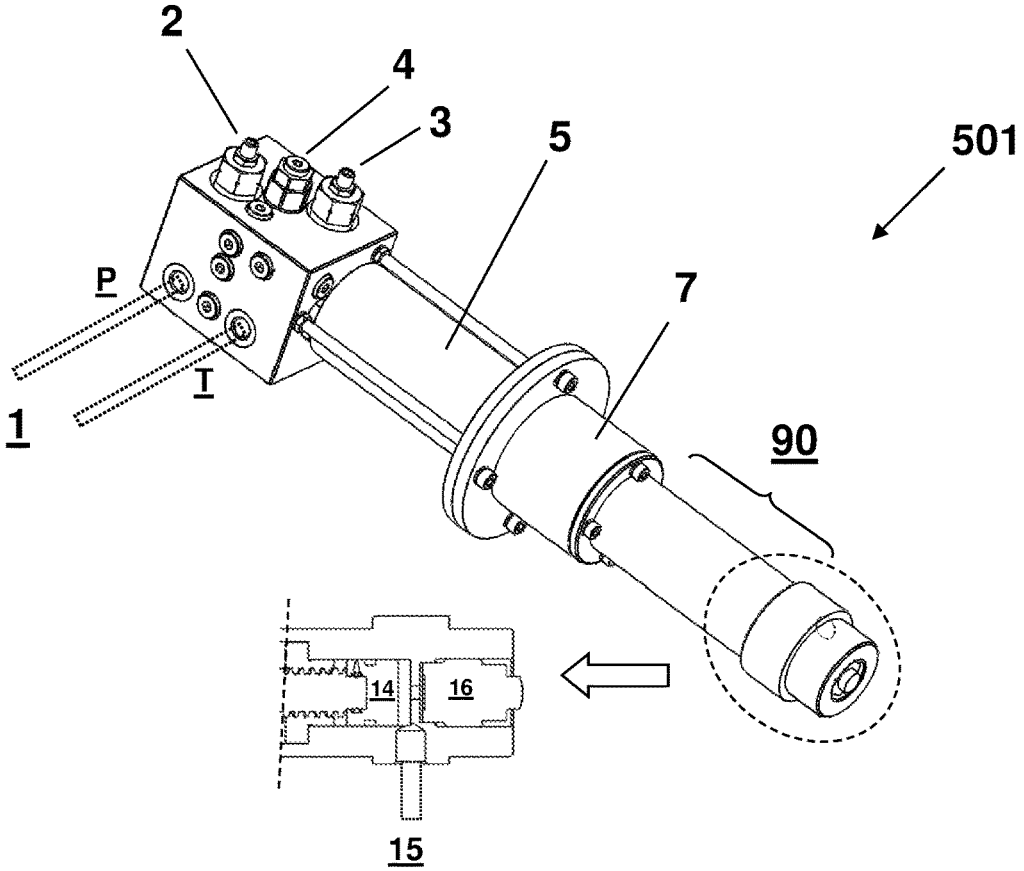

FIGS. 3A and 3B provide perspective views of the embodiment of HIB 501, while the partial cross-sectional view at the lower side of FIG. 3B of a downstream side of mechanism 90—illustrates possible provision of accumulator 16 at an end of mechanism 90 in this example embodied in a cylinder formation. High pressure line 15 is here seen branching off from mechanism 90 of HIB 501 from in between accumulator 16 and the piston 14—so that e.g. hydraulic fluid from line 15 while being applied to load piston 14 from downstream may also urge accumulator 16 here to the right-hand side to accumulate an amount of fluid required for operation of the HIB as already discussed.

Figure 4:
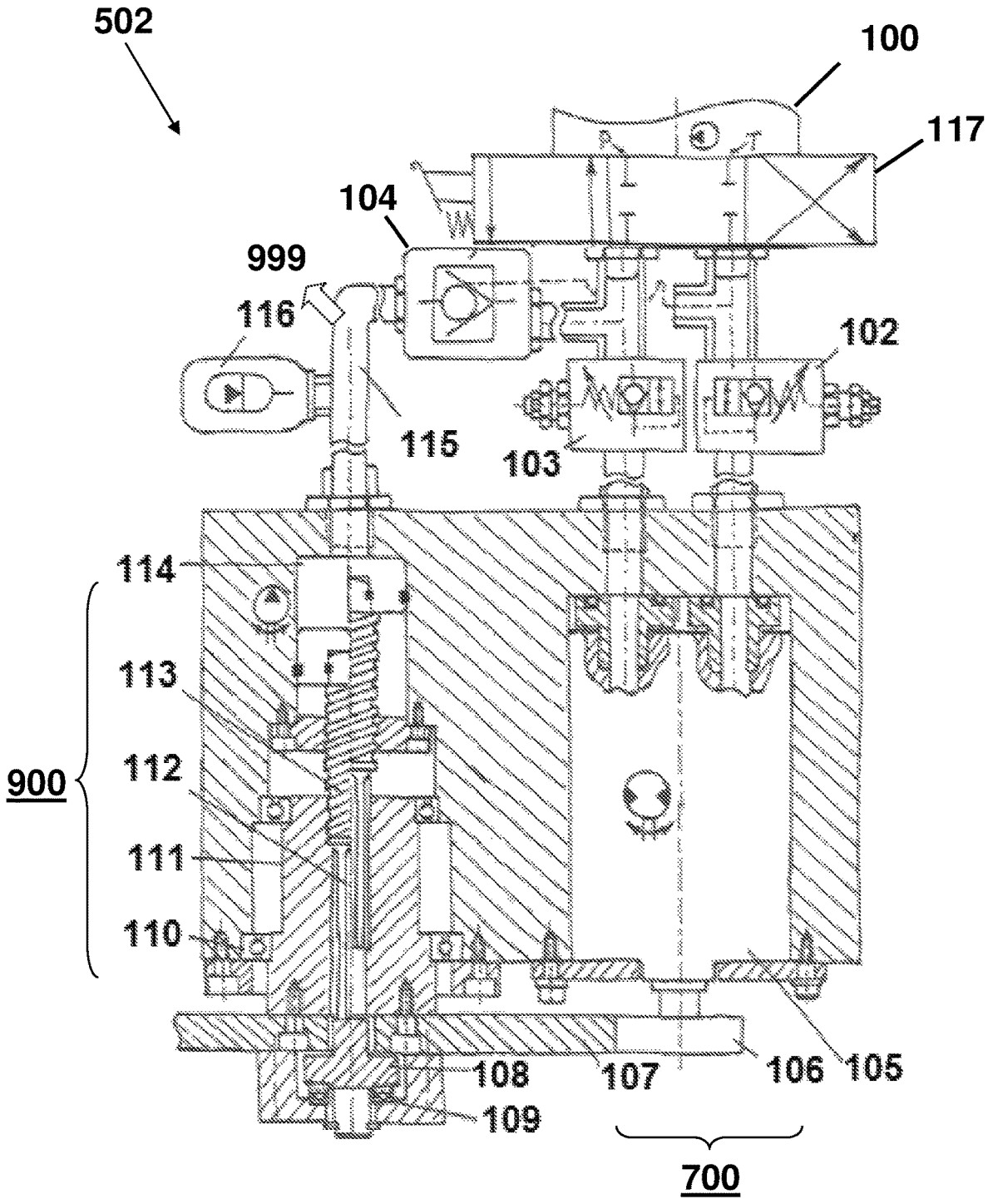
FIG. 4 schematically shows another embodiment of a hydraulic intensifier and/or booster (HIB) of the invention.

Attention is drawn to FIG. 4 illustrating an embodiment of a hydraulic intensifier and/or booster (HIB) 502 of the invention. A low-pressure pump 100 has a 'P' (pressure) side/port indicating a direction towards which fluid may be urged to move into a hydraulic circuit and a 'T' (tank) side/port indicating a side receiving fluid back from the circuit. Fluid power provided downstream may be defined, inter alia, by fluid pressure [N\m^2] and flow rate [m^3\sec].

The fluid power provided by pump 100, when being directed to flow according to the left stage of directional valve 117, may first arrive substantially simultaneously at a sequence valve 103 and a pilot-operated check valve 104 of HIB 502. Sequence valve 103 of HIB 502 may be configured to permit fluid to pass onwards downstream only after pressure upstream of the valve 103 exceeds a pre-defined, possibly adjustable, threshold. Sequence valve 103 in one example may include a spring-loaded mechanism that resists opening the valve until the pressure upstream (here provided by pump 100) manages to overcome the spring and consequently open the valve for downstream flow.

Still before sequence valve 103 opens, fluid power exiting port 'P' of the pump may also flow downstream via a check valve 104 (possibly a pilot check valve) of HIB 502 to fill a high-pressure line 115 in communication with the HIB. Pressure line 115 may be arranged to feed and provide fluid pressure to hydraulic components/appliances 999, which are in fluid communication with line 115. The fluid entering pressure line 115 through pilot-operated check valve 104 may encounter a downstream side of an intensification mechanism here embodied by a mechanism 900 of the HIB and hence the downstream side of mechanism 900 in this example may be a piston 114. The fluid entering pressure line 115 then fills the hydraulic circuit line 115, including all hydraulic components 999 connected to it, with hydraulic fluid. In addition, fluid filling pressure line 115 may be urged to fill an accumulator\single acting, spring return cylinder 116.

Once upstream line pressure exceeds the threshold set in sequence valve 103, the sequence valve opens and the hydraulic fluid flows downstream to operate a hydraulic motor 105 of the HIB. The hydraulic motor supplies power in the form of torque [Nm] and angular speed [rad\sec]. This power may be communicated downstream here via a reduction gearbox 700 of the HIB to mechanism 900 (here including cog-wheels 106, 107), which increases pressure of the hydraulic fluid in pressure line 115.

Mechanism 900 in this example is seen including thrust 109 and radial 110 bearings, a stopper 108, a spline bushing 111, a spline shaft 112 which may be connected to a lead screw with piston 114 connected to it as shown. Piston 114 is embodied in this figure in a split view in order to illustrate the full stroke that the piston may traverse during intensification. The left-hand side of piston 114 is seen at a relative rear state and the right-hand side of piston 114 at a relative forward state after completion of a stroke activated by the mechanism.

Since all hydraulic components connected to high pressure line 115 are already filled with hydraulic fluid and "trapped" between the pilot-operated check valve 104 and intensifier piston 114, as described above, any increase in pressure made by mechanism 900 may be arranged to directly affect the hydraulic components 999 in communication with pressure line 115.

Pump 100 in at least certain embodiments may be set in advance to stop supplying hydraulic fluid when the pressure built on port "P" reaches a given 'pump pressure limit' (e.g. between about 40 and 70 Bar). Such setting of the 'pump pressure limit' may be via a toggle or the like possibly available on the pump and/or via response to a pressure gauge monitoring pressure of the pump. In certain embodiments, pressure rising in line 115 against the external load on components 999 at a certain level may reach a 'motor pressure limit' where hydraulic motor 105 stops to rotate and advance its piston to build further pressure in line 115. In embodiments where the 'pump pressure limit' is set to be a higher than 'motor pressure limit'—the pump may continue to build pressure until pressure at its port "P" will reach the 'pump pressure limit' resulting in pump 100 substantially stopping its operation. If pressure on pump 100 drops for some reason, the pump may resume operation automatically and build up pressure again.

In certain embodiments, (as already noted with respect to some embodiments above) geometry of possible lead screw threads of mechanism 900 may prevent the release of the intensifying piston (self-locking) and thus maintain the high-pressure achieved in high-pressure line 115.

Reversing the action of the hydraulic circuit, by changing the circuit flow direction, for example by a directional control valve 117, operated manually (as shown in FIG. 4) or by a solenoid, may permit unloading pressure within pressure line 115. The fluid power provided by pump 100 may now be arranged, when being directed to flow according to the right stage of directional valve 117, to arrive substantially simultaneously at a sequence valve 102 and a pilot-operated check valve 104 of the HIB.

Still before sequence valve 102 opens, fluid power exiting port 'P' of the pump may flow downstream towards the pilot-operated check valve 104 of the HIB and urge it to open and release pressure at a downstream side of pressure line 115 since the reduction ratio of pilot to check pressure for release (5:1 in one example) was set in advance so the pilot will operate before sequence valve 102 opens.

Once upstream line pressure exceeds the threshold set in sequence valve 102, the sequence valve 102 may open and the hydraulic fluid may flow downstream towards the hydraulic motor 105. Since the output shaft of the hydraulic motor may substantially not be loaded, as possibly described above, the hydraulic fluid may flow via a sequence valve 102 of HIB 502 towards hydraulic motor 105 to urge it to rotate in a reverse direction, retracting the piston, while accumulator\single acting, spring return cylinder 116 may replenish the volume of hydraulic fluid utilized in the intensification stroke, possibly preparing it for the next intensification cycle. This may ensure that the intensification stroke will start and end at approximately the same points in the intensification cylinder from cycle to cycle. By this reverse action, the hydraulic components/appliances 999 in communication with pressure line 115 may be de-activated.

Figure 5A:
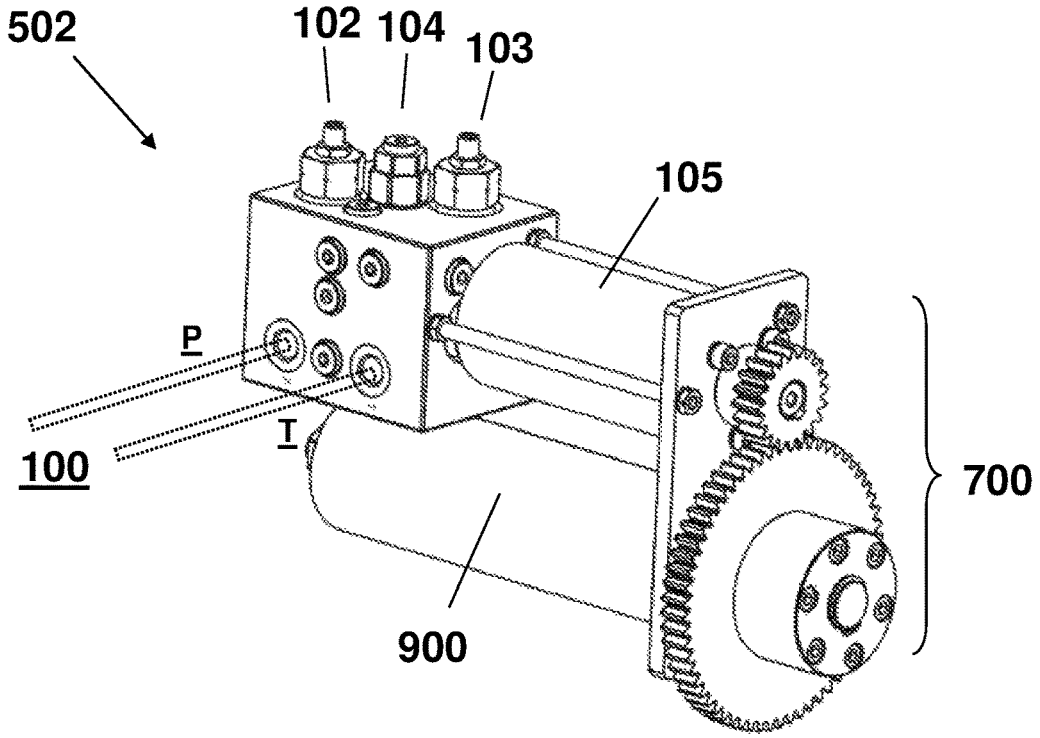
FIGS. 5A and 5B schematically show perspective views of an embodiment of a hydraulic intensifier and/or booster (HIB) of the invention generally similar to that in FIG. 4.
Figure 5B:
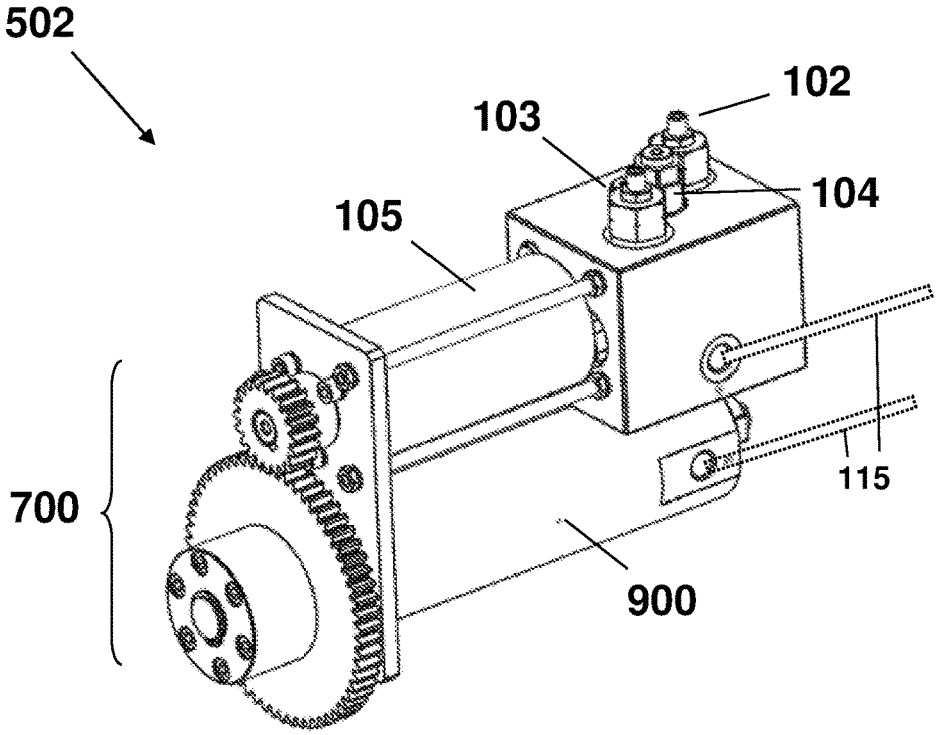

The illustrations provided in FIGS. 5A and 5B provide a view of the HIB embodiment 502 just described, where the low-pressure pump line (here 100) and the high-pressure line (here 115) have been added in dotted lines. Accordingly, in various embodiments, these lines may not necessarily be part of a hydraulic intensifier and/or booster (HIB) device but rather may be externally connected to such HIB device together with relevant components. In other embodiments, such lines and/or components may accordingly be integral to the HIB.

It is noted that a wide variety of HIB performance characteristics may be achieved by altering combinations of parameters: such as Hydraulic motor parameters (output torque & angular speed), gearbox parameters (reduction ratio) and/or piston parameters (stroke & area).

Figure 6A:
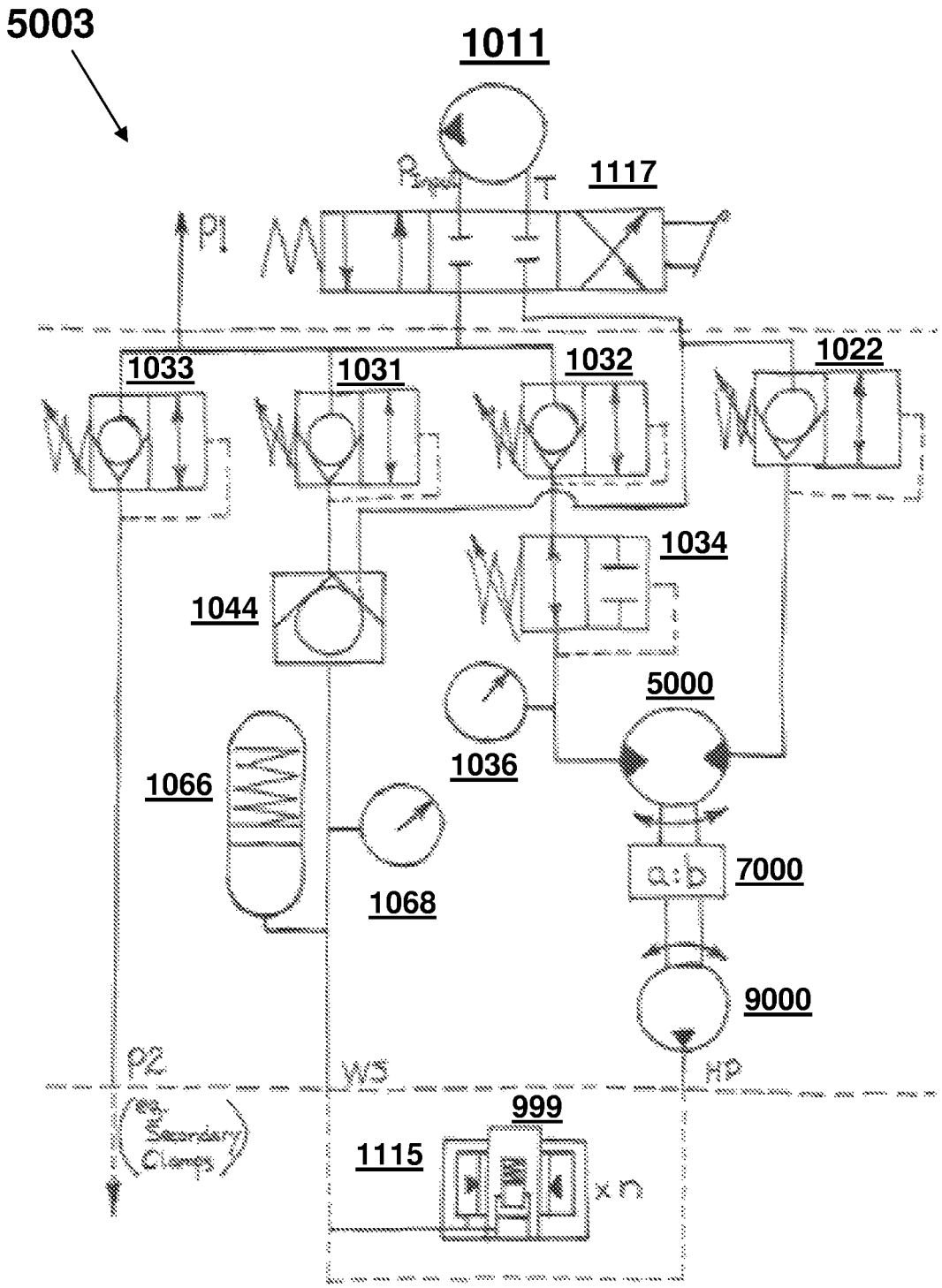
FIG. 6A schematically shows an embodiment of a hydraulic controller (HC) of the present invention.

Attention is drawn to FIG. 6A illustrating an embodiment of a hydraulic controller (HC) 5003 of the invention suitable for controlling hydraulic work holding fixtures (HWF). Hydraulic controller (HC) 5003 may encompass at least in part functionally and/or principles of operation and/or mechanisms and/or components of the above-mentioned HIB embodiments. The hydraulic controller may be a stand-alone device arranged to be releasably coupled to external tools and/or devices that can be activated by hydraulic power, such as those of a work holding fixtures (HWF).

A principle possibly applicable to most HC embodiments may be use of hydraulic power for control/activating of transitions within the HC resulting in outgoing changes in pressure which are configured to urge changes in externally coupled components/appliances (such as work holding fixtures (HWF) and the like). Such hydraulic control/activation instead of e.g. electrically activated or controlled mechanisms may be more suitable for certain environments such as environments where fluids such as oil or water may be present and/or environments where moving parts may render use of electrical wiring (or the like) less suitable. In at least certain embodiments, such transitions within the HC may be due to changes in incoming low pressures into the HC from a low-pressure pump resulting in provision of outgoing higher pressures for the activation of externally coupled components/appliances.

In an embodiment, HC 5003 may be arranged to communicate power along three hydraulic circuits, while ensuring that the fixture coupled to the hydraulic circuits operate in a proper order and at proper timings so as to properly activate workpiece clamping and support devices. Thus, HC 5003 in these embodiments may enable operation of high pressure work supports and devices while being fed from an incoming integral to the machine or external of the machine low-pressure power source.

A first hydraulic circuit P1 communicating power out of the HC may be defined for activation of a first set of components e.g. datum clamps of or associated to a hydraulic work holding fixture. A second hydraulic circuit P2 communicating power out of the HC may be defined for activation of a second set of components e.g. secondary clamps of or associated to a hydraulic work holding fixture. And a third HP (high pressure) hydraulic circuit communicating power out of the HC may be defined for activation of a third set of components 999 e.g. work supports of or associated to a hydraulic work holding fixture, which are in fluid communication with a high-pressure line 1115.

A low-pressure pump 1011 in fluid communication with HC 5003 has a 'P' (pressure) side/port indicating a direction towards which fluid is urged to move into a hydraulic circuit and a 'T' (tank) side/port indicating a side receiving fluid back from the circuit. Fluid power provided downstream may be defined, inter alia, by fluid pressure [N\m^2] and flow rate [m^3\sec].

Activation of pump 1011 to urge fluid out of port 'P', urges fluid to flow first, when being directed to flow according to the left stage of directional valve 1117, via the first hydraulic circuit P1 to activate in the discussed example 'datum clamps' in fluid communication with HC 5003. The fluid power provided by pump 1011 may also be arranged to arrive substantially simultaneously at three sequence valves 1031, 1032 and 1033 of controller 5003 each being configured to permit fluid to pass onwards downstream only after pressure upstream exceeds certain pre-defined, possibly adjustable, thresholds. Sequence valve 1031 may be defined as having a threshold $T_{31}$; sequence valve 1032 a threshold $T_{32}$ and sequence valve 1033 a threshold $T_{33}$. In an embodiment of the invention the thresholds of these three sequence valves may be defined as satisfying a relation of $T_{31}<T_{32}<T_{33}$—so that sequence valve 1031 may be arranged to open first, then sequence valve 1032 and finally sequence valve 1033.

Once upstream line pressure exceeds threshold $T_{31}$, sequence valve 1031 may open to permit the hydraulic fluid to flow downstream via a pilot-operated check valve 1044 of the controller to fill a high-pressure line 1115 in communication with the HC controller. The fluid entering pressure line 1115 through pilot-operated check valve 1044 may encounter a downstream side of an intensification mechanism here embodied by a mechanism 9000 of the HC and hence the downstream side of mechanism 9000 in this example may be an intensifying piston. The fluid entering pressure line 1115 may then fill the hydraulic circuit line 1115, including substantially all hydraulic components 999 connected to it, with hydraulic fluid. In addition, fluid filling pressure line 1115 may be urged to fill an accumulator\single acting, spring return cylinder 1066.

As pressure upstream continues to rise and exceeds threshold $T_{32}$, sequence valve 1032 may be the second one to open permitting hydraulic fluid to flow downstream via a possible pressure limiter 1034 (can be either fixed or adjustable) of the controller to arrive at a hydraulic motor 5000 of the controller. Pressure limiter 1034 may permit pressure to drop and/or may function in at least certain scenarios to prevent pressure buildup in the intensifier's cylinder so that it may not exceed a maximal desired, possibly pre-defined, hydraulic pressure in that line.

Since in this example substantially all hydraulic components connected to high pressure line 1115 are already substantially filled with hydraulic fluid and "trapped" between the pilot-operated check valve 1044 and intensifier piston 9000, as described above, any increase in pressure made by intensifier piston of mechanism 9000, derived in this example from the rotation of the spline shaft/lead screw—may be arranged to directly affect the hydraulic components 999 in fluid communication with pressure line 1115.

Once upstream line pressure exceeds the threshold set in sequence valve 1032, the sequence valve 1032 may open and the hydraulic fluid may flow downstream towards the hydraulic motor. The hydraulic motor supplies power in the form of torque [Nm] and angular speed [rad\sec]. This power may be communicated downstream via a gear 7000 of the controller to an intensifier piston, here preferably embodied as part of mechanism 9000 of the controller, which increases pressure of the hydraulic fluid within pressure line 1115, including substantially all hydraulic components 999 in communication with pressure line 1115.

Since high pressure in line 1115 builds up against the external load on components 999 (here work supports) eventually causing the hydraulic motor to stop from rotating, pressure upstream continues to rise and exceeds threshold $T_{33}$. Sequence valve 1033 may now be the third valve to open, permitting hydraulic fluid to flow downstream towards hydraulic circuit P2 communicating the fluid out of the controller for possible activation in this discussed example of secondary clamps. Thus, the HC 5003 in various embodiments may be a stand-alone device configured for outputting three pressure commands for activating appliances external to the controller.

Pump 1011 in at least certain embodiments may be set in advance to stop supplying hydraulic fluid when the pressure built on port "P" reaches a given 'pump pressure limit' (e.g. between about 40 and 70 Bar). Such setting of the 'pump pressure limit' may be via a toggle or the like possibly available on the pump and/or via response to a pressure gauge monitoring pressure of the pump. In certain embodiments, pressure rising in line HP against the external load on components 999, at a certain level may reach a 'motor pressure limit' where hydraulic motor 5000 stops to rotate and advance its piston to build further pressure in line 1115. In embodiments where the 'pump pressure limit' is set to be a higher than 'motor pressure limit'—the pump may continue to build pressure until pressure at its port "P" will reach the 'pump pressure limit' resulting in pump 1011 substantially stopping its operation. If pressure on pump 1011 drops for some reason, the pump may resume operation automatically and build up pressure again.

In certain embodiments, geometry of possible lead screw threads of mechanism 9000 may prevent the release of the intensifying piston (self-locking) and thus maintain the high-pressure achieved in high-pressure line 1115.

Reversing the action of the hydraulic circuit, by changing the circuit flow direction, for example by a directional control valve 1117, operated manually (as shown in FIG. 6A) or by a solenoid, may permit release of pressure within pressure lines in the controller. The fluid power provided by pump 1011 may now be arranged, when being directed to flow according to the right stage of directional valve 1117, to arrive substantially simultaneously at a sequence valve 1022 and a pilot-operated check valve 1044.

Still before sequence valve 1022 opens, fluid power exiting port 'T' of the pump may flow downstream towards the pilot-operated check valve 1044 and urge it to open and release pressure at a downstream side of pressure line 1115 since the reduction ratio of pilot to check pressure for release (5:1 in one example) was set in advance so the pilot-operated check valve 1044 will operate before sequence valve 1022 opens. Thrust on hydraulic motor shaft 5000, gear 7000 and mechanism 9000 is being released simultaneously together with the pressure release.

Once upstream line pressure exceeds the threshold set in sequence valve 1022, the sequence valve 1022 may open and the hydraulic fluid may flow downstream towards the hydraulic motor 5000. Since the output shaft of the hydraulic motor may substantially not be loaded, as possibly described above the hydraulic fluid may flow via a sequence valve 1022 of hydraulic controller (HC) 5003 towards hydraulic motor 5000 and urge it rotate in a reverse direction, retracting the piston, while accumulator\single acting, spring return cylinder 1066 may replenish the volume of hydraulic fluid utilized in the intensification stroke, preparing it for the next intensification cycle. This may ensure that the intensification stroke will start and end at approximately the same points in the intensification cylinder from cycle to cycle. By this reverse action, the hydraulic components/appliances 999 in communication with pressure line 1115 may be de-activated. Pressure gauges 1036, 1068 may be arranged for providing pressure indication and/or feedback from a vicinity of motor 5000 and pressure line 1115, respectively.

Figure 6B:
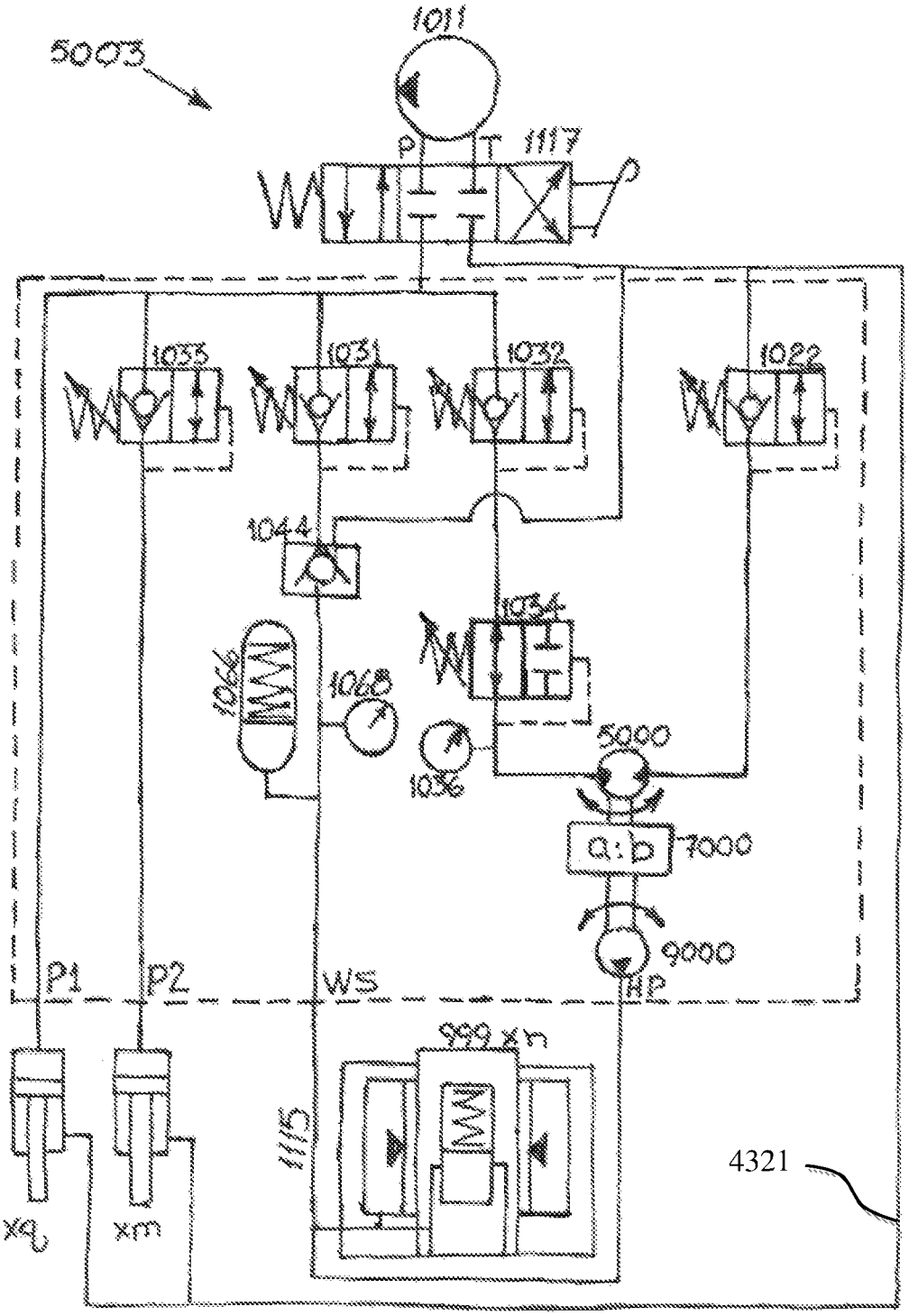
FIGS. 6B and 6C schematically show additional embodiments of a hydraulic controller (HC) of the present invention.

Attention is drawn to FIG. 6B illustrating a hydraulic controller (HC) 5003 generally similar to that in FIG. 6A—however here exemplifying how retraction of components in communication with hydraulic circuits P1 and P2 may be actuated. In the HC 5003 of FIG. 6B it is seen how when reversing the action of the hydraulic circuit by directing fluid to flow according to the right stage of directional valve 1117, the fluid being provided by pump 1011 may flow also via a flow passage 4321 that communicates with a downstream side of the components in communication with hydraulic circuits P1 and P2. Hydraulic fluid entering these components (e.g. datum clamps, secondary clamp, or the like)—may assist in formation of a retraction stroke in the typical double acting cylinders of the components in communication with circuits P1 and P2.

Figure 6C:
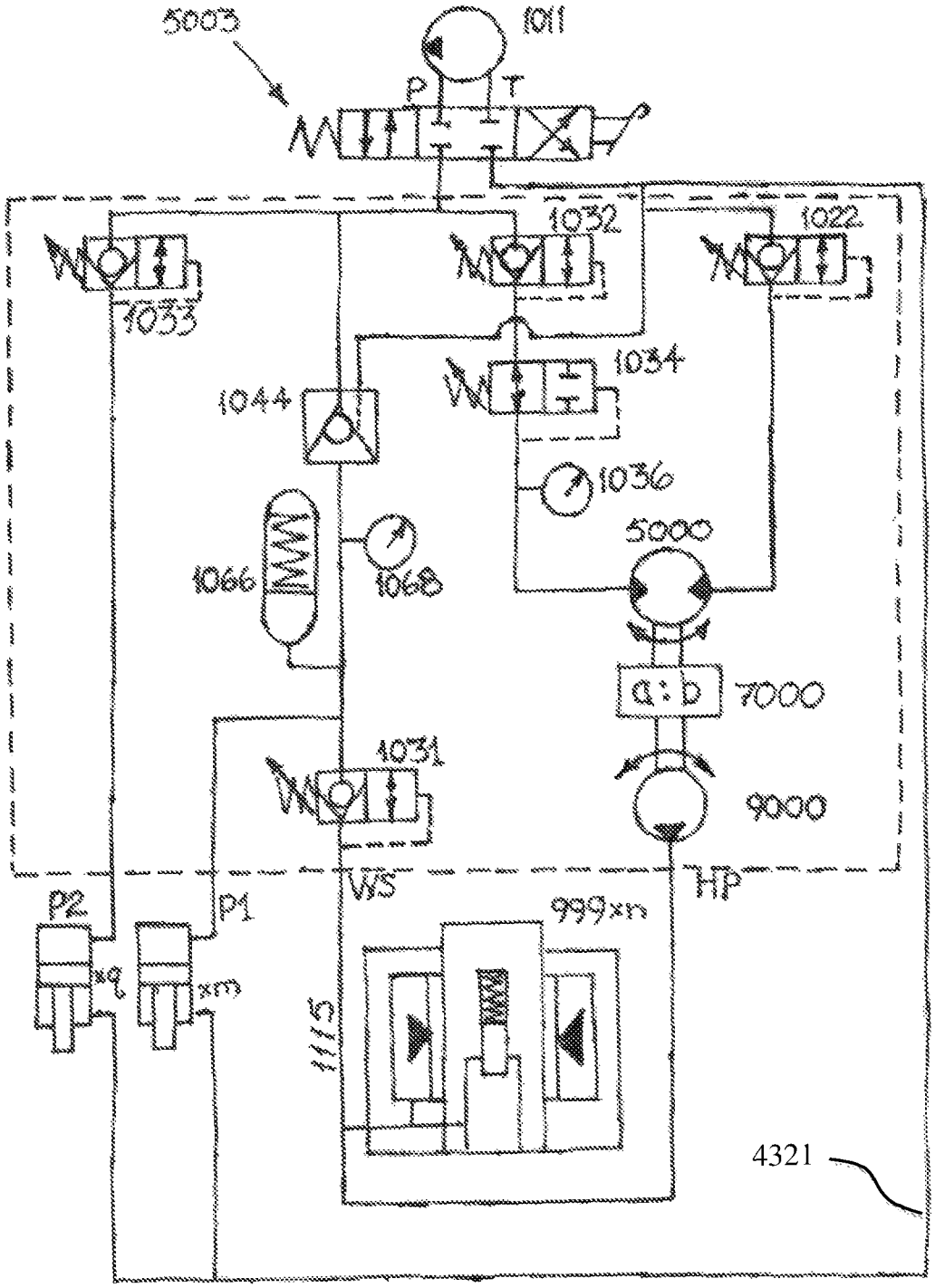

Attention is drawn to FIG. 6C exemplifying an embodiment of a hydraulic controller (HC) 5003 generally similar to those in FIGS. 6A and 6B—however here being configured for communicating the increased pressure built in pressure line 1115 also via circuit P1 towards the components in communication with circuit P1.

It is noted that such increased pressures now communicated via circuit P1—may permit using smaller and/or lighter hydraulic components—to form generally similar forces to those formed e.g. in the HC of FIGS. 6A and 6B by larger and/or heavier hydraulic components (e.g. main datum clamps). This may be possible—since e.g. smaller areas (e.g. pistons) in such components now exposed to higher pressures—may typically be tuned to provide generally equivalent forces to those formed by e.g. larger areas (e.g. pistons) in components that are exposed to lower pressures (as in FIGS. 6A and 6B).

In addition it is noted that the location of circuit P1 within the hydraulic circuitry of the HC of FIG. 6C—provides further control to the timing of activation of the hydraulic components coupled to circuit P1. Since as opposed to the HC of FIGS. 6A and 6B where circuit P1 fills up after starting motor 1011—in the HC of FIG. 6C—circuit P1 will start receiving relative low pressures after exceeding the threshold level of sequence valve 1031 and the more higher pressures suitable for its activation after exceeding the threshold level of sequence valve 1032.

In the following the operation of the HC embodiment of FIG. 6C will be described. Activation of pump 1011 to urge fluid out of port 'P', urges fluid to flow first, when being directed to flow according to the left stage of directional valve 1117, through pilot operated check valve 1044 thereby filling the circuit P1 with hydraulic fluid. The purpose of the first hydraulic circuit P1 is to activate in the discussed example 'datum clamps' in fluid communication with the HC. The fluid power provided by pump 1011 as in the former HC embodiments arrives at the three sequence valves 1031, 1032 and 1033 of the controller, where each such sequence valve is configured to permit fluid to pass onwards downstream only after pressure upstream exceeds certain pre-defined, possibly adjustable, thresholds. Sequence valve 1031 may be defined as having a threshold $T_{31}$; sequence valve 1032 a threshold $T_{32}$ and sequence valve 1033 a threshold $T_{33}$. In an embodiment of the invention the thresholds of these three sequence valves may be defined as satisfying a relation of $T_{31}<T_{32}<T_{33}$—so that sequence valve 1031 may be arranged to open first, then sequence valve 1032 and finally sequence valve 1033.

Once upstream line pressure exceeds threshold $T_{31}$, sequence valve 1031 may open to permit the hydraulic fluid to flow downstream thus filling high-pressure line 1115 in communication with the HC. The fluid entering pressure line 1115 along with the fluid which previously entered circuit P1 may encounter a downstream side of an intensification mechanism here embodied by a mechanism 9000 of the HC and hence the downstream side of mechanism 9000 in this example may be an intensifying piston. The fluid entering pressure line 1115 may then fill the hydraulic circuit line 1115, including substantially all hydraulic components 999 connected to it, with hydraulic fluid. In addition, fluid filling pressure lines P1 and 1115 may be urged to fill an accumulator\single acting, spring return cylinder 1066 here located in between sequence valve 1031 and check valve 1044.

As pressure upstream continues to rise and exceeds threshold $T_{32}$, sequence valve 1032 may be the second one to open permitting hydraulic fluid to flow downstream via a possible pressure limiter 1034 (can be either fixed or adjustable) of the controller to arrive at a hydraulic motor 5000 of the controller. Pressure limiter 1034 may permit pressure to drop and/or may function in at least certain scenarios to prevent pressure buildup in the intensifier's cylinder so that it may not exceed a maximal desired, possibly pre-defined, hydraulic pressure in that line.

Since in this example substantially all hydraulic components connected to circuit P1 and high pressure line 1115 are already substantially filled with hydraulic fluid and "trapped" between the pilot-operated check valve 1044 and intensifier piston 9000, as described above, any increase in pressure made by intensifier piston of mechanism 9000, derived in this example from the rotation of the spline shaft/lead screw—may be arranged to directly affect the hydraulic components in fluid communication with pressure lines P1 and 1115.

Once upstream line pressure exceeds the threshold set in sequence valve 1032, the sequence valve 1032 may open and the hydraulic fluid may flow downstream towards the hydraulic motor. The hydraulic motor supplies power in the form of torque [Nm] and angular speed [rad\sec]. This power may be communicated downstream via a gear 7000 of the controller to an intensifier piston, here preferably embodied as part of mechanism 9000 of the controller, which increases pressure of the hydraulic fluid within pressure lines P1 and 1115, including substantially all hydraulic components in communication with these pressure lines P1 and 1115.

Since high pressure in lines P1 and 1115 build up against the external load on components (here datum clamps and work supports) eventually causing the hydraulic motor to stop from rotating, pressure upstream continues to rise and exceeds threshold $T_{33}$. Sequence valve 1033 may now be the third valve to open, permitting hydraulic fluid to flow downstream towards hydraulic circuit P2 communicating the fluid out of the controller for possible activation in this discussed example of secondary clamps. Thus, the HC in various embodiments may be a stand-alone device configured for outputting three pressure commands for activating appliances external to the controller.

Pump 1011 in at least certain embodiments may be set in advance to stop supplying hydraulic fluid when the pressure built on port "P" reaches a given 'pump pressure limit' (e.g. between about 40 and 70 Bar). Such setting of the 'pump pressure limit' may be via a toggle or the like possibly available on the pump and/or via response to a pressure gauge monitoring pressure of the pump. In certain embodiments, pressure rising in line HP against the external load on components, at a certain level may reach a 'motor pressure limit' where hydraulic motor 5000 stops to rotate and advance its piston to build further pressure in lines P1 and 1115. In embodiments where the 'pump pressure limit' is set to be a higher than 'motor pressure limit'—the pump may continue to build pressure until pressure at its port "P" will reach the 'pump pressure limit' resulting in pump 1011 substantially stopping its operation. If pressure on pump 1011 drops for some reason, the pump may resume operation automatically and build up pressure again.

In certain embodiments, geometry of possible lead screw threads of mechanism 9000 may prevent the release of the intensifying piston (self-locking) and thus maintain the high-pressure achieved in high-pressure lines P1 and 1115.

Reversing the action of the hydraulic circuit, by changing the circuit flow direction, for example by a directional control valve 1117, operated manually (as shown in FIG. 6) or by a solenoid, may permit release of pressure within pressure lines in the controller. The fluid power provided by pump 1011 may now be arranged, when being directed to flow according to the right stage of directional valve 1117, to arrive substantially simultaneously at a sequence valve 1022 and a pilot-operated check valve 1044.

Still before sequence valve 1022 opens, fluid power exiting port 'T' of the pump may flow downstream towards the pilot-operated check valve 1044 and urge it to open and release pressure at a downstream side of pressure lines P1 and 1115 since the reduction ratio of pilot to check pressure for release (5:1 in one example) was set in advance so the pilot will operate before sequence valve 1022 opens. Thrust on hydraulic motor shaft 5000, gear 7000 and mechanism 9000 is being released simultaneously together with the pressure release.

Once upstream line pressure exceeds the threshold set in sequence valve 1022, the sequence valve 1022 may open and the hydraulic fluid may flow downstream towards the hydraulic motor 5000. Since the output shaft of the hydraulic motor may substantially not be loaded, as possibly described above the hydraulic fluid may flow via a sequence valve 1022 of hydraulic controller (HC) towards hydraulic motor 5000 and urge it rotate in a reverse direction, retracting the piston, while accumulator\single acting, spring return cylinder 1066 may replenish the volume of hydraulic fluid utilized in the intensification stroke, preparing it for the next intensification cycle. This may ensure that the intensification stroke will start and end at approximately the same points in the intensification cylinder from cycle to cycle. By this reverse action, the hydraulic components/appliances in communication with pressure lines P1 and 1115 may be deactivated. Pressure gauges 1036, 1068 may be arranged for providing pressure indication and/or feedback from a vicinity of motor 5000 and pressure lines P1 and 1115, respectively.

Figure 7A:
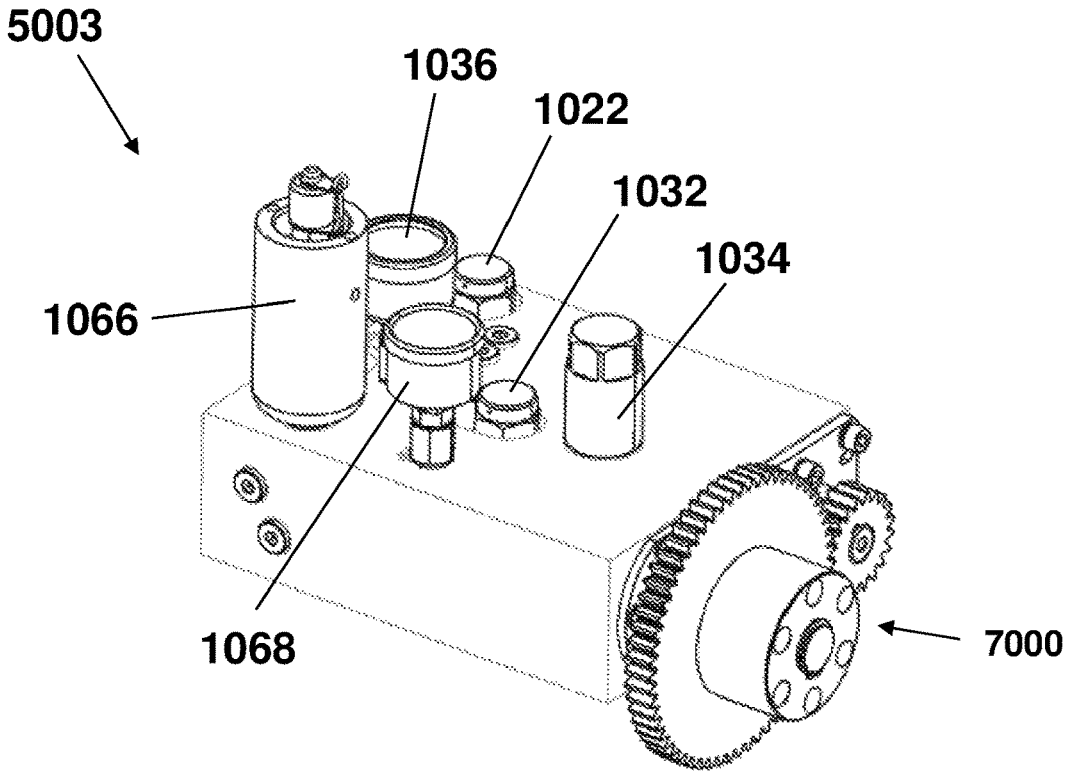
FIGS. 7A and 7B schematically show perspective views of a hydraulic controller generally similar to that in FIG. 6.
Figure 7B:
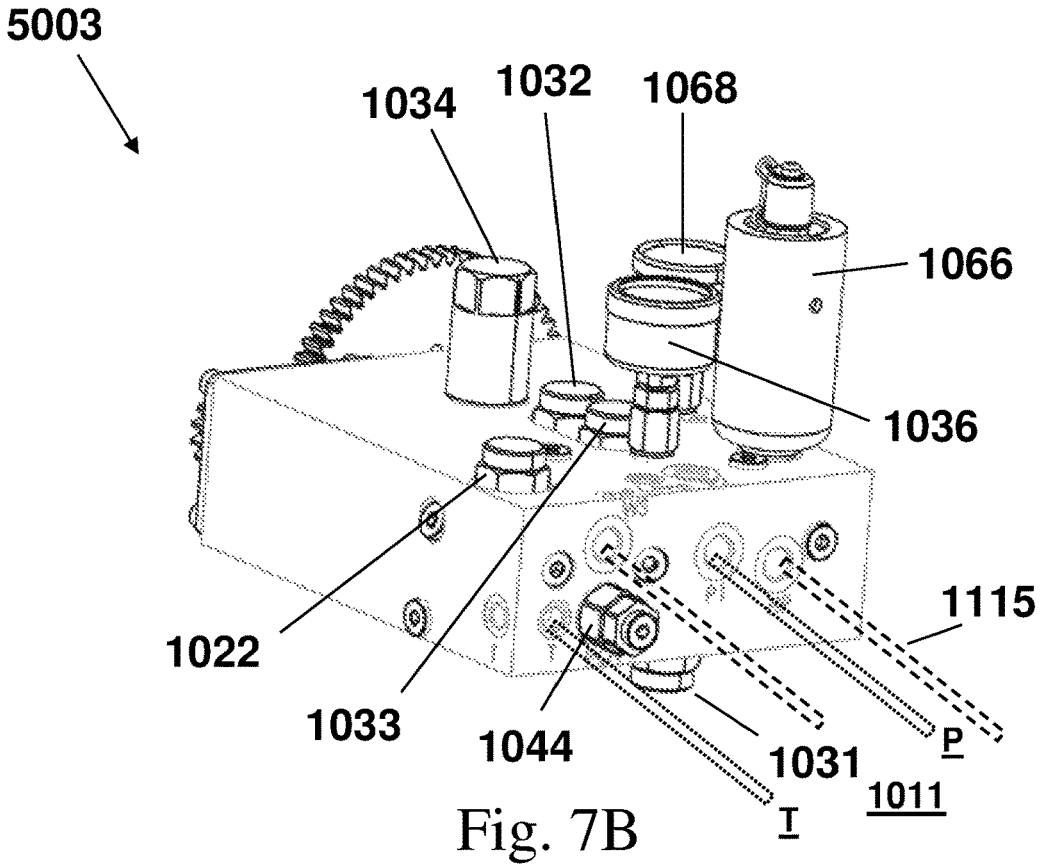

Attention is drawn to FIGS. 7A and 7B illustrating perspective views of an embodiments of a hydraulic controller generally similar to that discussed with respect to FIG. 6.

Attention is drawn to FIGS. 8A to 8E illustrating possible use of a hydraulic controller (HC) 5005 generally similar to the aforementioned embodiment of HC 5003 in controlling a hydraulic work holding fixture (HWF) 6000 that is mounted to a machine tool, here a computer-controlled machining center (CNC) 8000.

Figure 8A:
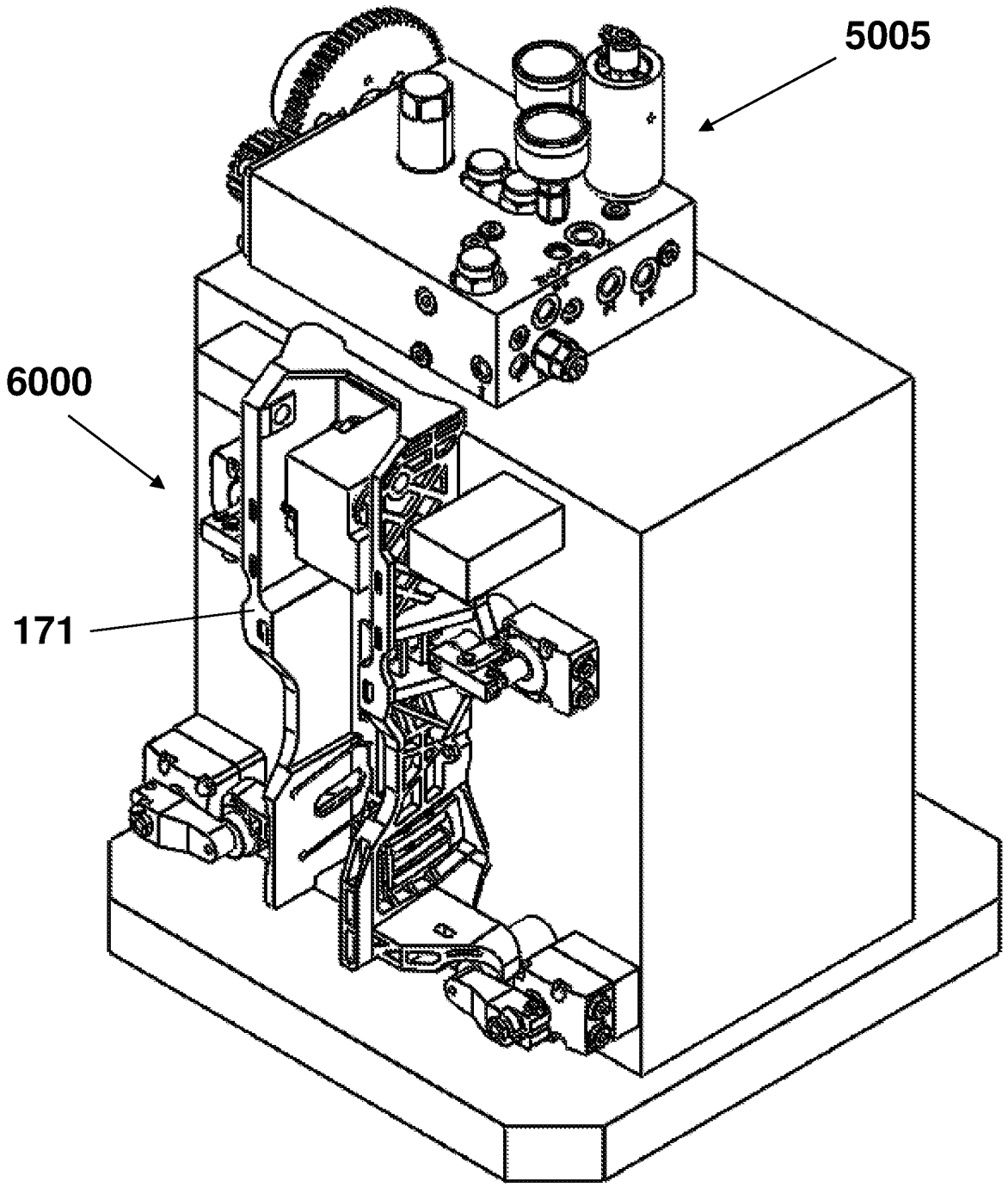
FIGS. 8A to 8E schematically show possible use of an embodiment of a hydraulic controller (HC) coupled in communication with a hydraulic work holding fixture (HWF) in a machine tool, here a computer-controlled (CNC) machining center.
Figure 8B:
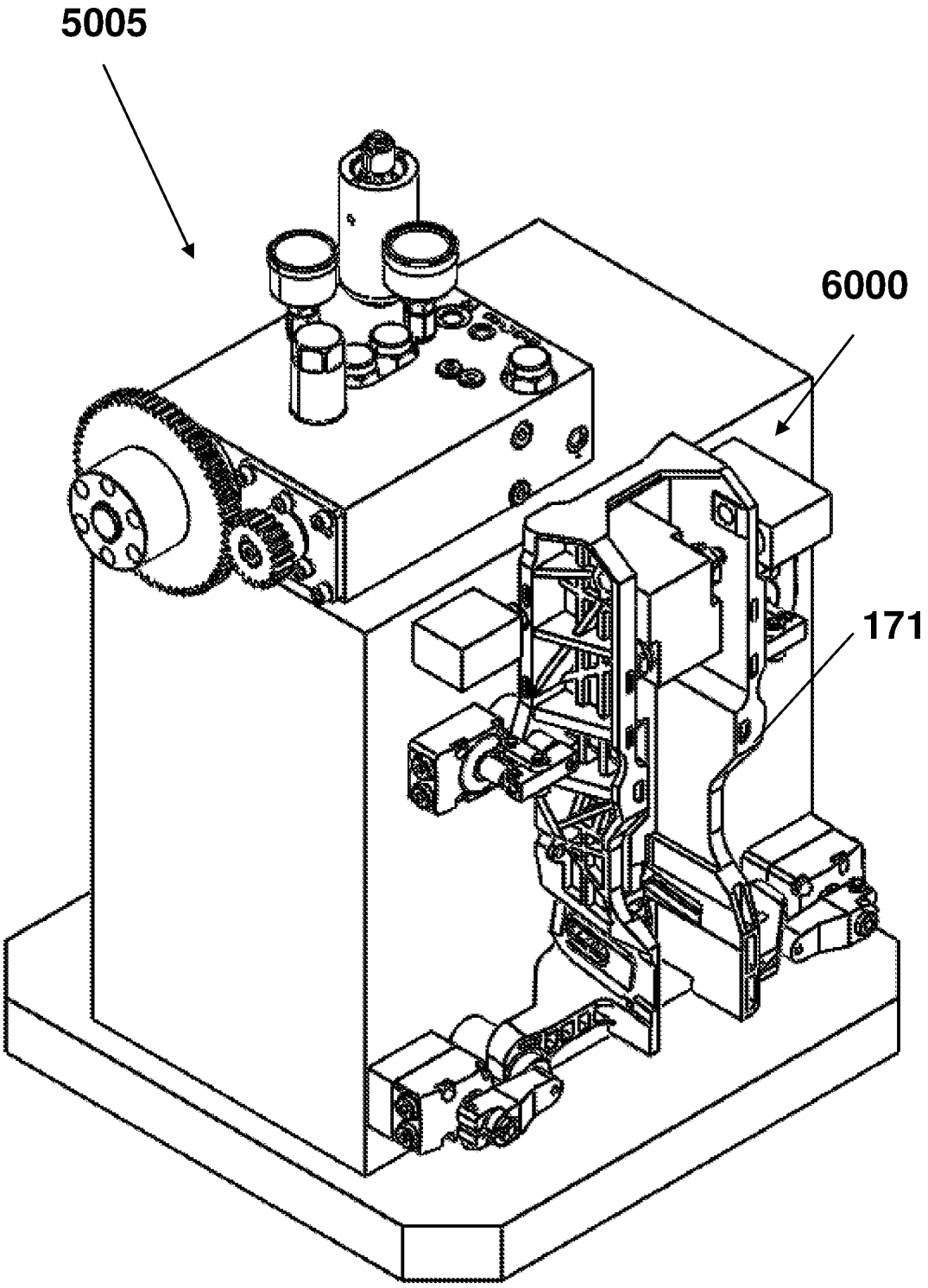
Figure 8C:
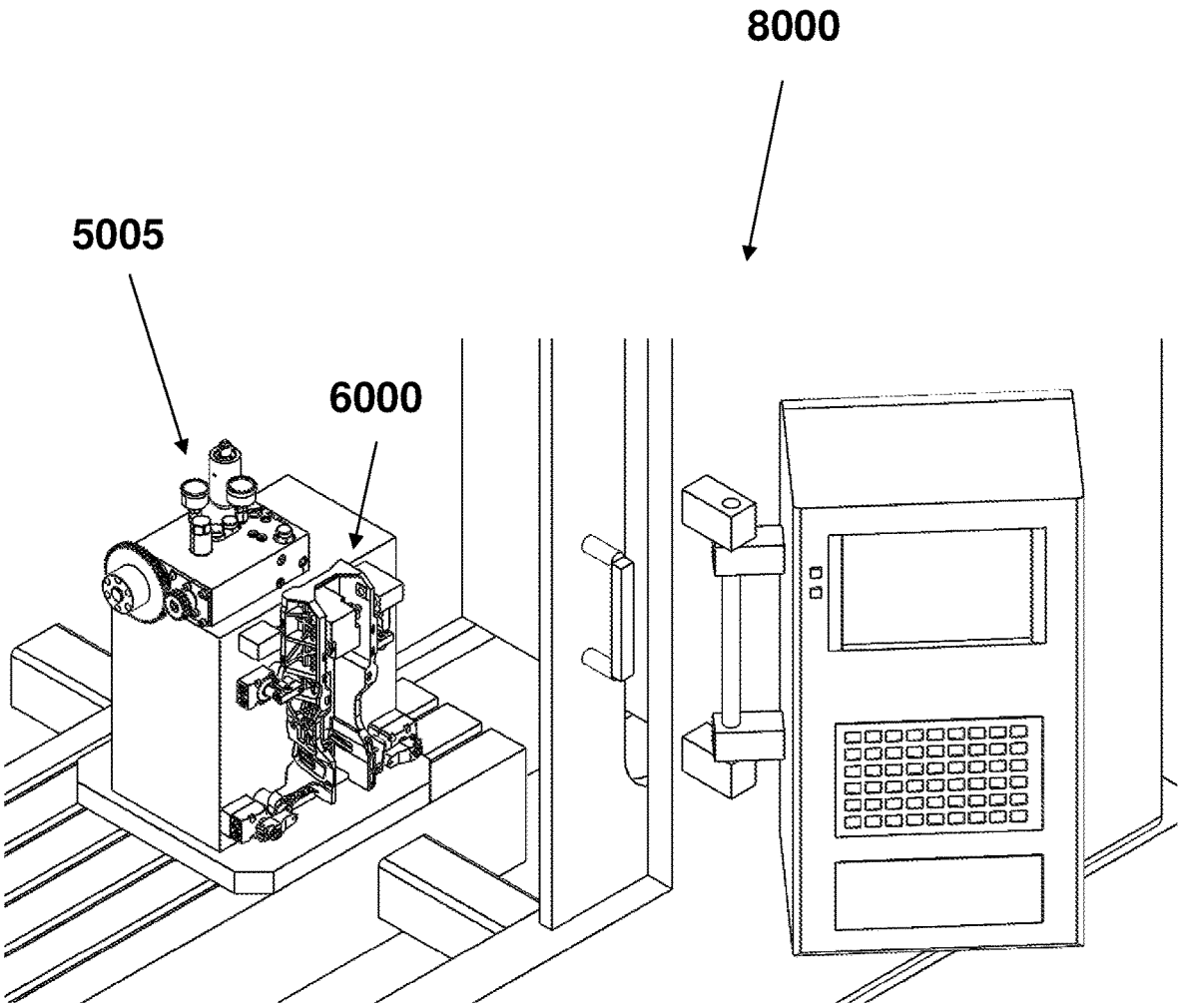
Figure 8D:
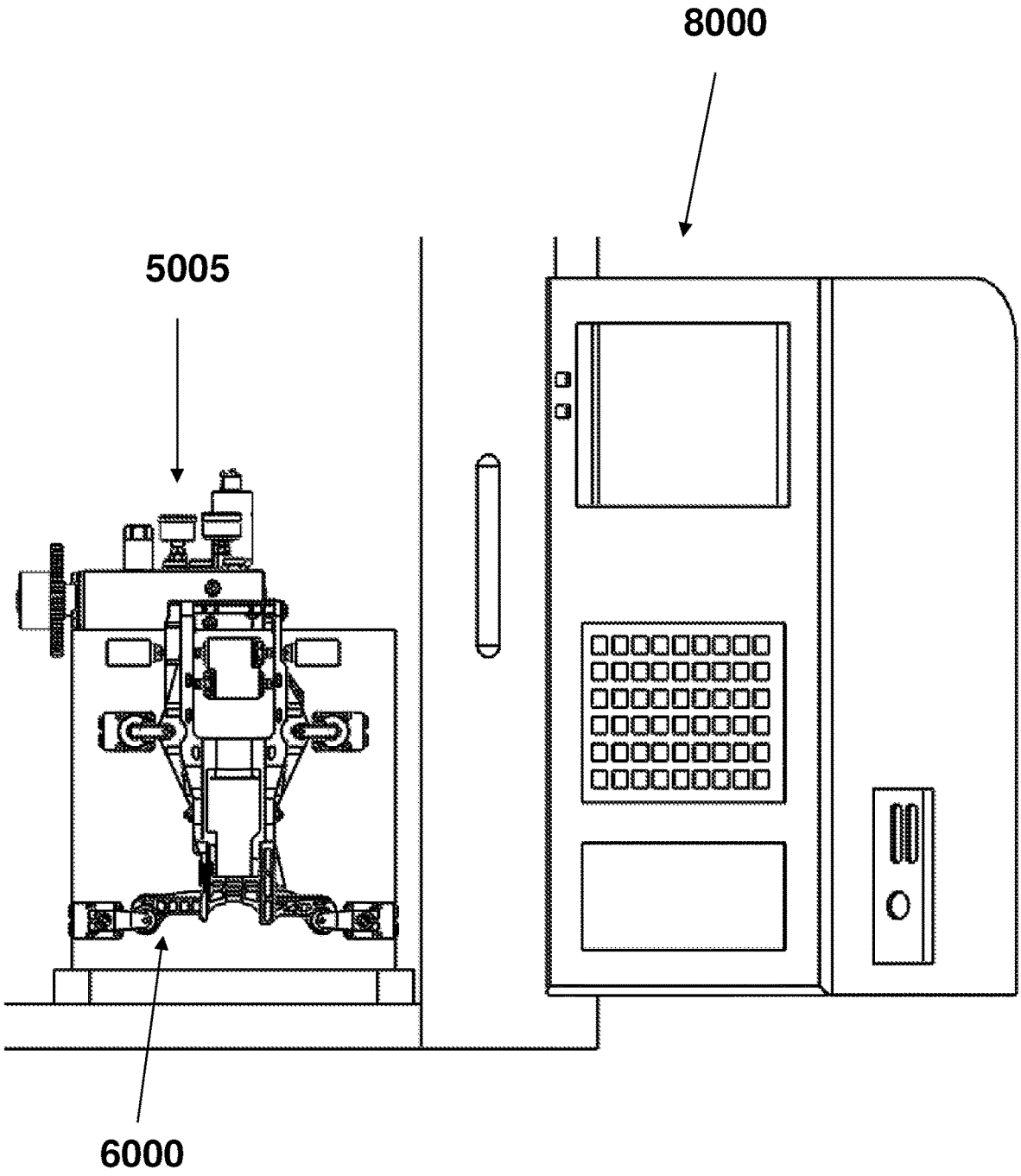
Figure 8E:
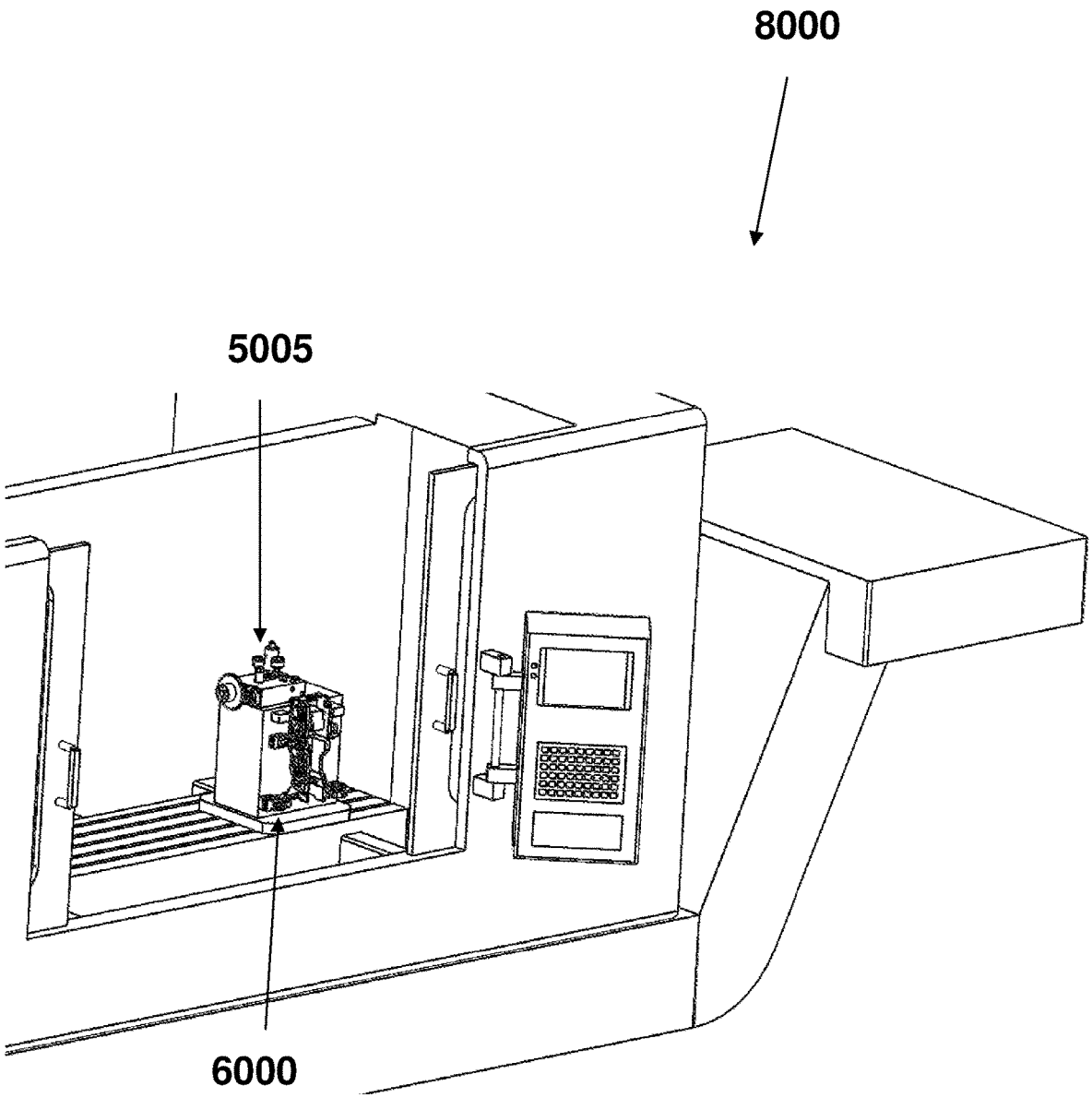

FIGS. 8A and 8B, illustrate the hydraulic controller (HC) 5005 coupled together with the hydraulic work holding fixture (HWF) 6000, which in turn holds onto a part 171 being produced in a manufacturing process. FIGS. 8C to 8D illustrate the hydraulic controller (HC) 5005 and a hydraulic work holding fixture (HWF) 6000 mounted on a CNC machine 8000.

A fixture designer may make use of such embodiment(s) of the hydraulic controller (HC) to simplify the task of designing the work holding fixture, so that the designer can concentrate on designing the work holding fixture with its three circuits: 'Datum Clamp Circuit', 'Work Supports Circuit' and 'Secondary Clamps Circuit'.

By employing embodiment(s) of hydraulic controller and connecting the hydraulic circuits in the work holding fixture to corresponding ports in the controller, the fixture designer may ensure that the fixture's three hydraulic circuits will preferably operate in a proper order and at a proper timing so as to properly activate workpiece clamping and support devices.

Such operation(s) may accordingly be enabled by various HC embodiments being arranged to facilitate operation of outgoing high-pressure work supports and devices while same HC embodiments being fed by low pressure power source(s) preferably devoid of any leaks and vulnerability to contaminants.

In certain cases, a user, e.g. a fixture designer, designing the fixture controls himself/herself, may employ the use of various standalone Hydraulic Intensifier/Booster (HIB) embodiments described herein in a fixture to boost the Hydraulic Pressure in work support circuit(s).

In such case a user may design fixture hydraulic controls such that the high-pressure line of the fixture may be filled with hydraulic fluid prior to activating a Hydraulic Intensifier/Booster embodiment. In such an application the control elements for the fixture may be incorporated into the fixture by the designer and mounted on the fixture itself.

Attention is drawn to FIGS. 9A to 9D to illustrate such cases where a HIB such as 501 seen in FIGS. 2, 3A and 3B may be used to form an embodiment of a work holding fixture controller—providing substantially same control functionality as hydraulic controller (HC) 5003.

In the example shown (see in particular FIG. 9A) the following elements will be exemplified and/or marked where in some cases dual numerals may be provided for certain elements, to indicate how an element in HIB 501 may be designed to provide functionally generally similar to that in HC 5003. For example, in FIG. 9A sequence valve 2 of HIB 501 may also be marked as 1022 to indicate its role in a controller providing substantially similar control functionally as HC 5003.

HIB 501, accordingly includes two sequence valves 2/1022 and 3/1032, a pilot operated check valve 4/1044,) a hydraulic motor 5/5000, a gearbox 7/7000 and an intensifying piston/cylinder 9/9000.

Figure 9A:
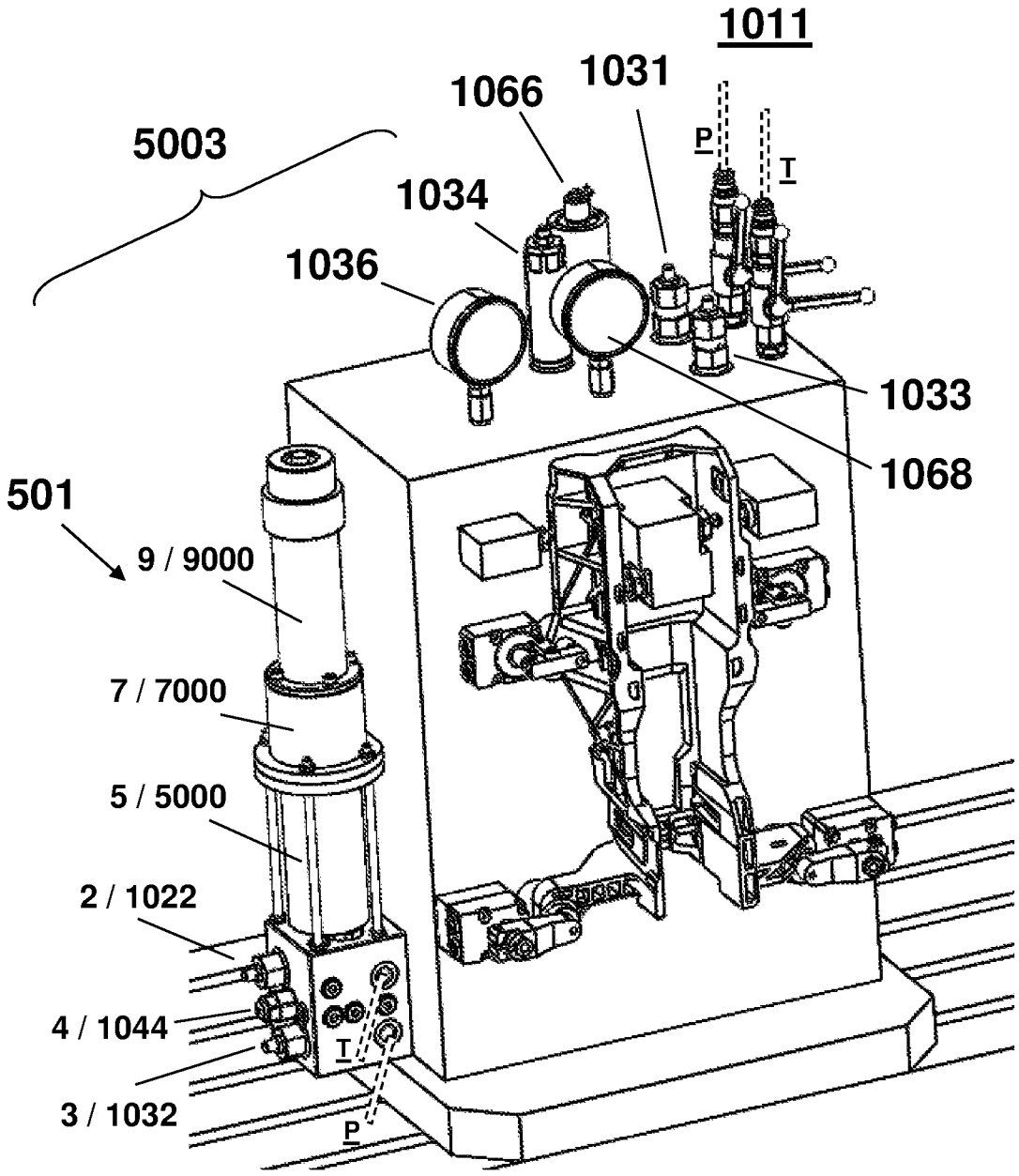
FIGS. 9A to 9D schematically show possible use of an embodiment of a Hydraulic Intensifier/Booster (HIB) in communication with components forming therewith a hydraulic controller (HC) embodiment—arranged for controlling a hydraulic work holding fixture (HWF) in a machine tool, here a computer-controlled CNC machining center.
Figure 9B:
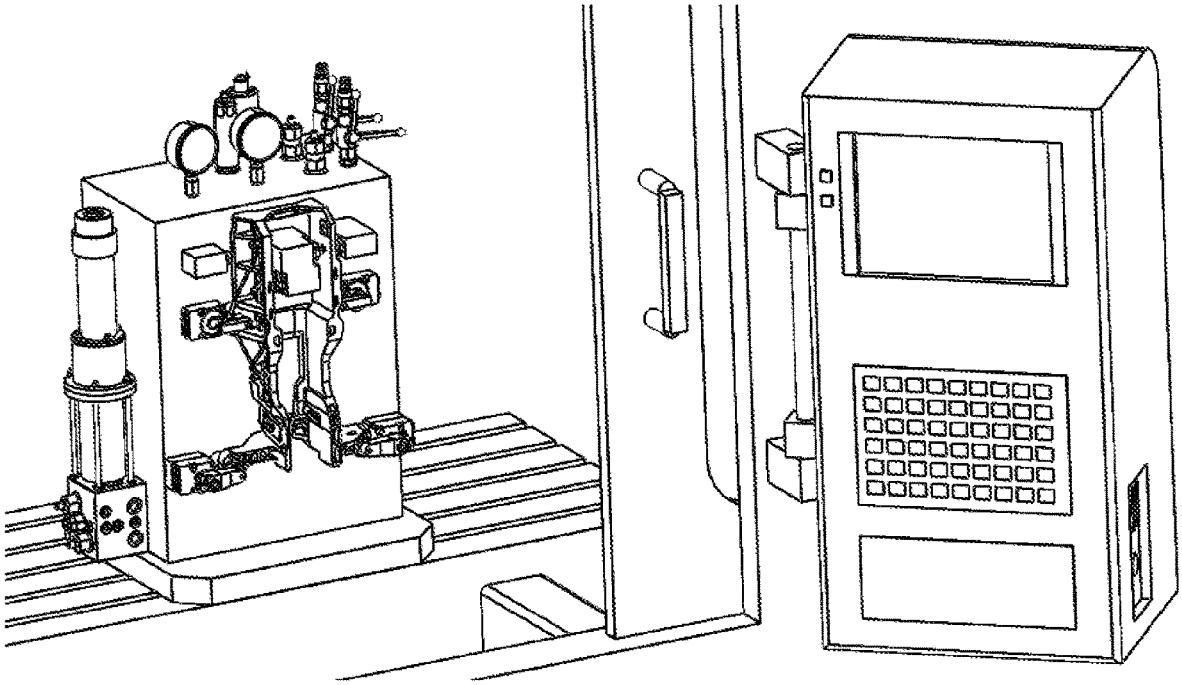
Figure 9C:
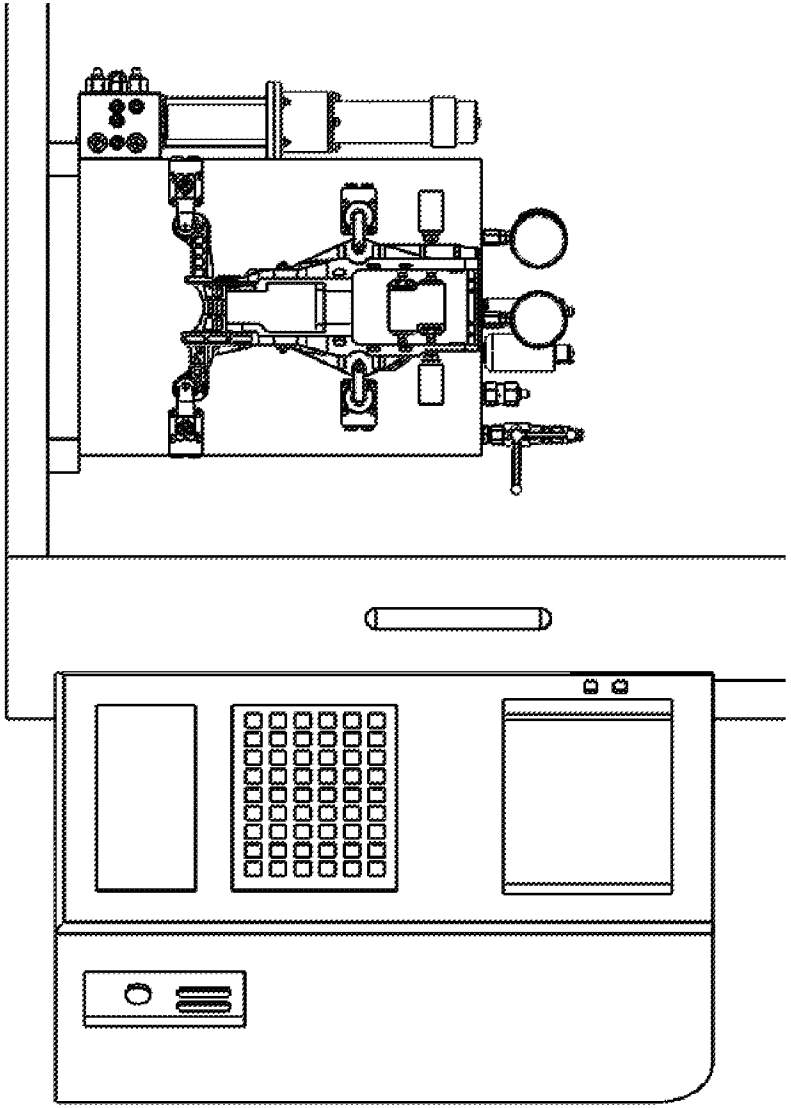
Figure 9D:
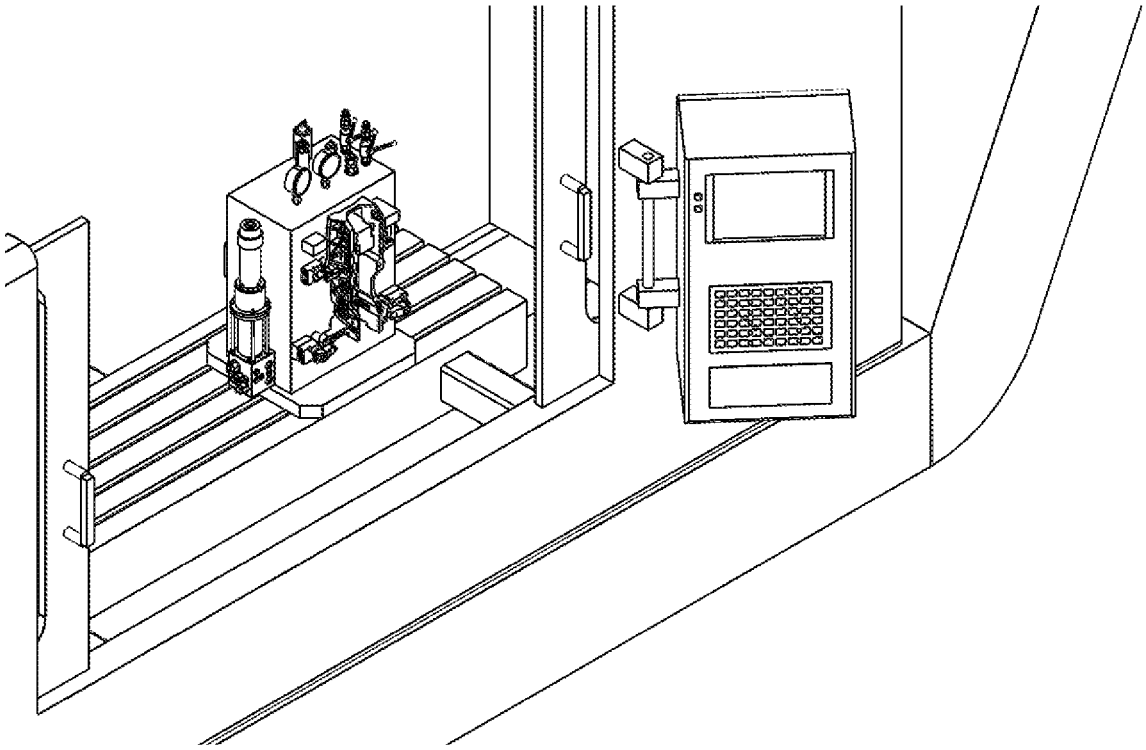

The remaining control elements in FIG. 9A are here exemplified incorporated into the fixture so that:

the datum clamp circuit may be activated upon activation of the low-pressure pump 1011.

A sequence valve 1031 fitted to the fixture subsequently may be arranged to open to allow hydraulic fluid to pass through the pilot operated check valve 4/1044 on the standalone hydraulic intensifier HIB 501 to fill the high-pressure line with hydraulic fluid.

Sequence valve 3/1032 on the standalone intensifier may be arranged to open to allow for the operation of the hydraulic motor on the intensifier thereby increasing the hydraulic pressure in the high-pressure line according to the limit governed by the pressure limiting valve 1034 on the fixture.

Sequence valve 1033 on the fixture can then open to activate the secondary clamps on the fixture.

Release of the clamped part may be done by changing the position of the directional control valve (manual or electric) of the low-pressure pump.

Fluid flowing now as if it would leave from the "T" port of the HIB to the pilot operated check valve 4/1044 on the standalone hydraulic intensifier may be arranged to unseat the check valve allowing pressure to drop in the high-pressure line 1115.

At the same time fluid may flow from the low-pressure pump to sequence valve 2/1022 on the standalone hydraulic intensifier. When the pressure at sequence valve 2/1022 reaches the set threshold in the valve, hydraulic fluid may be allowed to flow to the hydraulic motor 5/5000 which rotates the power train made up of the gearbox (planetary or spur gear reduction), the spline shaft lead screw thereby retracting the intensifying piston.

Hydraulic fluid may then be arranged to flow back to the tank of the low-pressure pump thereby deactivating all of the hydraulic elements 999 on the high-pressure line 1115.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

Furthermore, while the present application or technology has been illustrated and described in detail in the drawings and foregoing description, such illustration and description are to be considered illustrative or exemplary and non-restrictive; the technology is thus not limited to the disclosed embodiments. Variations to the disclosed embodiments can be understood and effected by those skilled in the art and practicing the claimed technology, from a study of the drawings, the technology, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures can not be used to advantage.

The present technology is also understood to encompass the exact terms, features, numerical values or ranges etc., if in here such terms, features, numerical values or ranges etc. are referred to in connection with terms such as "about, ca., substantially, generally, at least" etc. In other words, "about 3" shall also comprise "3" or "substantially perpendicular" shall also comprise "perpendicular". Any reference signs in the claims should not be considered as limiting the scope.

Although the present embodiments have been described to a certain degree of particularity, it should be understood that various alterations and modifications could be made without departing from the scope of the invention as hereinafter claimed.

The invention claimed is:

1. A hydraulic intensifier booster (HIB) for transforming an incoming hydraulic pressure at a relative low-pressure to an amplified outgoing hydraulic pressure at a relative high-pressure, the HIB comprising a hydraulic motor and an intensifying mechanism in the form of a hydraulic screw pump mechanism comprising a piston, wherein the hydraulic motor receives the incoming hydraulic pressure to output power, and the intensifying mechanism being arranged to receive the outputted power from the hydraulic motor and transform it to linear power of the piston, wherein the intensifying mechanism via the piston being arranged to build and communicate the amplified outgoing hydraulic pressure to a high-pressure line of the HIB, the HIB further comprising a second sequence valve for communicating incoming hydraulic fluid entering via a tank port T of the HIB towards the hydraulic motor, wherein the second sequence valve being arranged to permit the incoming hydraulic fluid to pass onwards downstream only after pressure upstream of the second sequence valve exceeds a pre-defined, possibly adjustable, threshold, and wherein the incoming hydraulic fluid before flowing past the second sequence valve towards the hydraulic motor, is configured to first urge open a pilot operated check valve of the HIB in communication with the high-pressure line to consequently release incoming hydraulic pressure at the high-pressure line.

2. The HIB of claim 1 and being arranged to receive the incoming hydraulic pressure from a low-pressure pump.

3. The HIB of claim 2, wherein the low-pressure pump can be powered hydraulically or electrically.

4. The HIB of claim 3 and being arranged to communicate the amplified outgoing hydraulic pressure to the high-pressure line, possibly in communication with hydraulic components/appliances.

5. The HIB of claim 4, wherein the intensifying mechanism is arranged to build the amplified outgoing hydraulic pressure between the pilot operated check valve of the HIB and the piston.

6. The HIB of claim 5, wherein the hydraulic components/appliances being located between the pilot operated check valve and the piston.

7. The HIB of claim 4 and comprising an accumulator in fluid communication with the high-pressure line, wherein possibly the accumulator is in form of a single acting, spring return hydraulic cylinder.

8. The HIB of claim 7 wherein the accumulator being arranged for replenishing hydraulic fluid towards the high-pressure line.

9. The HIB of claim 1 and comprising an incoming port P, wherein building of hydraulic pressure from the incoming hydraulic pressure is when the incoming hydraulic fluid enters via incoming port P and exits towards the tank port T.

10. The HIB of claim 9 and comprising a first sequence valve for communicating the incoming hydraulic pressure entering via the incoming port P towards the hydraulic motor, wherein the first sequence valve being arranged to permit fluid to pass onwards downstream only after pressure upstream of the valve exceeds a pre-defined, possibly adjustable, threshold.

11. The HIB of claim 1, wherein the hydraulic motor being arranged to receive power in the form of pressure [N\m^2] and flow rate [m^3\sec] and provide the output power in the form of torque [Nm] and angular velocity [rad\sec].

12. The HIB of claim 11, wherein the intensifying mechanism being arranged to receive the output power in the form of torque [Nm] and angular velocity [rad\sec] and provide the linear power in the form of force [N] and stroke velocity [m\sec].

13. The HIB of claim 1, wherein the intensifying mechanism is arranged to build the amplified outgoing hydraulic pressure between the pilot operated check valve of the HIB and the piston, and wherein hydraulic fluid flowing past the second sequence valve towards the hydraulic motor urges a retraction\set back of the intensifying mechanism towards its starting position and additional drop in pressure in the amplified outgoing hydraulic pressure.

14. A hydraulic controller for hydraulically controlling logic and/or sequence of operation of work holding devices on a hydraulic work holding fixture by transforming incoming hydraulic pressure at a relative low-pressure to a plurality of outgoing hydraulic pressure routes, at least one route having a relatively higher pressure, and the controller comprising three sequence valves each being configured to permit fluid to pass onwards downstream only after pressure upstream exceeds certain pre-defined, possibly adjustable, thresholds, wherein each sequence valve has a different threshold, a first one of the sequence valves having the lowest threshold is arranged to communicate the incoming hydraulic pressure onwards downstream towards a high-pressure line in communication with hydraulic components of the work holding fixture, a second one of the sequence valves having a threshold higher than that of the first valve is arranged to communicate the incoming hydraulic pressure downstream towards a hydraulic motor, and a third one of the sequence valves having a threshold higher than that of the second one is arranged to communicate the incoming hydraulic pressure onwards towards the work holding fixture, for activating secondary clamps at the work holding fixture.

15. The hydraulic controller of claim 14, wherein the hydraulic motor that receives power in the form of pressure [N\m^2] and flow rate [m^3\sec] and provides output power in the form of torque [Nm] and angular velocity [rad\sec].

16. The hydraulic controller of claim 15 and comprising an intensifying mechanism arranged to receive the output power from the hydraulic motor and transform it to linear power of an intensifying piston in the form of force [N] and stroke velocity [m\sec], wherein the intensifying mechanism via the intensifying piston being arranged to build the relatively higher pressure communicated towards the hydraulic components of the work holding fixture, possibly located between a pilot operated check valve of the controller and the intensifying piston.

17. The hydraulic controller of claim 14 and comprising a fluid line for communicating the incoming hydraulic pressure directly, not through a sequence valve having an opening threshold, towards the work holding fixture, for possibly activating datum clamps in the work holding fixture.

18. The hydraulic controller of claim 17 and being arranged to be fitted on a machine tool, preferably together with the work holding fixture.

19. A method for transforming an incoming hydraulic pressure at a relative low-pressure to an amplified outgoing hydraulic pressure at a relative high-pressure, comprising the steps of: providing a hydraulic intensifier booster (HIB) comprising a hydraulic motor and a hydraulic screw pump intensifying mechanism, utilizing the incoming hydraulic pressure to urge an output power from the hydraulic motor that is then transformed by the intensifying mechanism to linear power of a piston in order to build and communicate the amplified outgoing hydraulic pressure to a high-pressure line of the HIB, possibly in communication with hydraulic components/appliances, the HIB further comprising an incoming port P, a tank port T and a first sequence valve, wherein building of the amplified outgoing hydraulic pressure from the incoming hydraulic pressure is when incoming hydraulic fluid enters via the incoming port P and exits towards the tank port T, and the first sequence valve communicating the incoming hydraulic pressure entering via the incoming port P towards the hydraulic motor only after the incoming hydraulic pressure upstream of the sequence valve exceeds a pre-defined, possibly adjustable, threshold, and wherein the incoming hydraulic fluid before passing via the first sequence valve towards the hydraulic motor is configured to flow and fill the high-pressure line.

20. The method of claim 19 and being arranged to receive the incoming hydraulic pressure from a low-pressure pump.

21. The method of claim 20, wherein the low-pressure pump can be powered hydraulically or electrically.

22. The method of claim 19 and comprising a second sequence valve for communicating the incoming hydraulic pressure entering via the tank port T towards the hydraulic motor, wherein the second sequence valve being arranged to permit the incoming hydraulic fluid to pass onwards downstream only after the incoming hydraulic pressure upstream of the second sequence valve exceeds a pre-defined, possibly adjustable, threshold.

23. The method of claim 22, wherein the incoming hydraulic fluid before flowing past the second sequence valve towards the hydraulic motor, is configured to first urge open a pilot operated check valve in communication with the high-pressure line receiving the amplified outgoing hydraulic pressure and consequently release the amplified outgoing hydraulic pressure at the high-pressure line.

24. The method of claim 23, wherein the intensifying mechanism is arranged to build the amplified outgoing pressure between the pilot operated check valve of the HIB and the piston, and wherein the incoming hydraulic fluid flowing passed the second sequence valve towards the hydraulic motor urges a retraction\set back of the intensifying mechanism towards its starting position and additional drop in pressure in the amplified outgoing hydraulic pressure.

25. The method of claim 19, wherein the hydraulic motor being arranged to receive power in the form of pressure [N\m^2] and flow rate [m^3\sec] and provide the output power in the form of torque [Nm] and angular velocity [rad\sec].

26. The method of claim 25, wherein the intensifying mechanism being arranged to receive the output power in the form of torque [Nm] and angular velocity [rad\sec] and provide the linear power in the form of force [N] and stroke velocity [m\sec].

27. The method of claim 19, wherein the intensifying mechanism is arranged to build the amplified outgoing hydraulic pressure between a pilot operated check valve of the HIB and the piston.

28. The method of claim 27, wherein the hydraulic components/appliances being located between the pilot operated check valve and the piston.

29. A method for controlling logic and/or sequence of operation of work holding devices on a hydraulic work holding fixture by transforming incoming hydraulic pressure at a relative low-pressure to a plurality of outgoing hydraulic pressure routes, at least one route having a relatively higher pressure, the method comprising the steps of: providing a hydraulic controller comprising at least three sequence valves, each being configured to permit fluid to pass onwards downstream only after the incoming hydraulic pressure upstream exceeds certain pre-defined, possibly adjustable, thresholds, wherein each sequence valve has a different threshold, a first one of the sequence valves having the lowest threshold is arranged to communicate the incoming hydraulic pressure onwards downstream towards high-pressure line in communication with hydraulic components of the work holding fixture, a second one of the sequence valves having a threshold higher than that of the first valve is arranged to communicate the incoming hydraulic pressure onwards downstream towards a hydraulic motor, and a third one of the sequence valves having a threshold higher than that of the second one is arranged to communicate the incoming hydraulic pressure onwards towards the work holding fixture, for activating secondary clamps at the work holding fixture.

30. The hydraulic controller of claim 29, wherein the hydraulic motor receives power in the form of pressure [N\m^2] and flow rate [m^3\sec] and outputs power in the form of torque [Nm] and angular velocity [rad\sec].

31. The method of claim 30 and comprising an intensifying mechanism arranged to receive the outputted power from the hydraulic motor and transform it to linear power of an intensifying piston in the form of force [N] and stroke velocity [m\sec], wherein the intensifying mechanism via the intensifying piston being arranged to build the relatively higher pressure communicated towards the hydraulic components of the work holding fixture, possibly located between a pilot operated check valve of the controller and the intensifying piston.

32. The method of claim 29 and comprising a fluid line for communicating the incoming hydraulic pressure directly, not through a sequence valve having an opening threshold, towards the work holding fixture, for possibly activating datum clamps in the work holding fixture.

33. The hydraulic controller of claim 29 and being arranged to be fitted on a machine tool, preferably together with the work holding fixture.

* * * * *